US006439701B1

(12) United States Patent
Taneya et al.

(10) Patent No.: US 6,439,701 B1
(45) Date of Patent: Aug. 27, 2002

(54) LIQUID DISCHARGE HEAD, HEAD CARTRIDGE AND LIQUID DISCHARGE APPARATUS

(75) Inventors: Yoichi Taneya, Yokohama; Sadayuki Sugama, Tsukuba; Hiroyuki Ishinaga, Tokyo; Masao Mori, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/625,845

(22) Filed: Jul. 26, 2000

(30) Foreign Application Priority Data

Jul. 27, 1999 (JP) ..... 11-212906

(51) Int. Cl.[7] ..... B41J 2/05
(52) U.S. Cl. ..... 347/65
(58) Field of Search ..... 347/65, 63, 94

(56) References Cited

U.S. PATENT DOCUMENTS

| | | | | |
|---|---|---|---|---|
| 4,723,129 A | | 2/1988 | Endo et al. | 347/56 |
| 5,182,577 A | | 1/1993 | Ishinaga et al. | 347/58 |
| 5,278,585 A | | 1/1994 | Karz et al. | 347/65 |
| 5,821,962 A | * | 10/1998 | Kudo et al. | 347/65 |

FOREIGN PATENT DOCUMENTS

| | | | |
|---|---|---|---|
| EP | 0436047 | 7/1991 | B41J/2/055 |
| EP | 0721841 | 7/1996 | B41J/2/05 |
| EP | 811493 | 12/1997 | B41J/2/05 |
| EP | 0 811 495 A2 | 12/1997 | |
| EP | 0 976 562 A2 | 2/2000 | |
| JP | 6031918 | 6/1994 | B41J/2/05 |
| JP | 9048127 | 2/1997 | B41J/3/04 |
| JP | 9323420 | 12/1997 | B41J/2/05 |

OTHER PUBLICATIONS

*JP 6031918 is the equivalent of 5,278,585.
*JP 9048127 is the equivalent of EP 0721841.
*JP 9323420 is the equivalent of EP 811493.

* cited by examiner

*Primary Examiner*—Thinh Nguyen
*Assistant Examiner*—Blaise Mouttet
(74) *Attorney, Agent, or Firm*—Fitzpatrick, Cella, Harper & Scinto

(57) ABSTRACT

The invention provides a liquid discharge head that includes a heat generating member for generating thermal energy for generating a bubble in liquid, a discharge port constituting a part for discharging the liquid, a liquid flow path communicating with the discharge port and having a bubble generating area for generating the bubble in the liquid, a movable member provided in the bubble generating area and adapted to displace with the growth of the bubble, and a limiting portion for limiting the displacement of the movable member within a desired range, the liquid discharge head being adapted to discharge the liquid from the discharge port by the energy at the generation of the bubble by the heat generating member.

38 Claims, 22 Drawing Sheets

FIG. 2A2
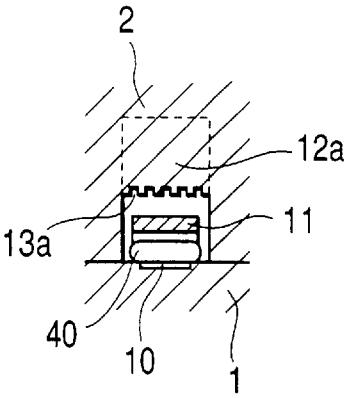
FIG. 2B2
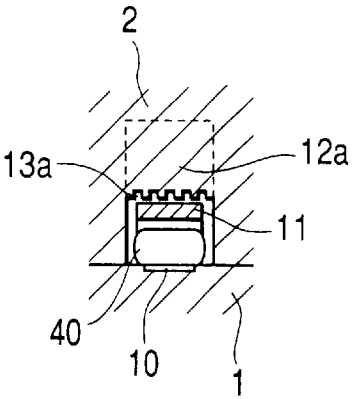
FIG. 2A1
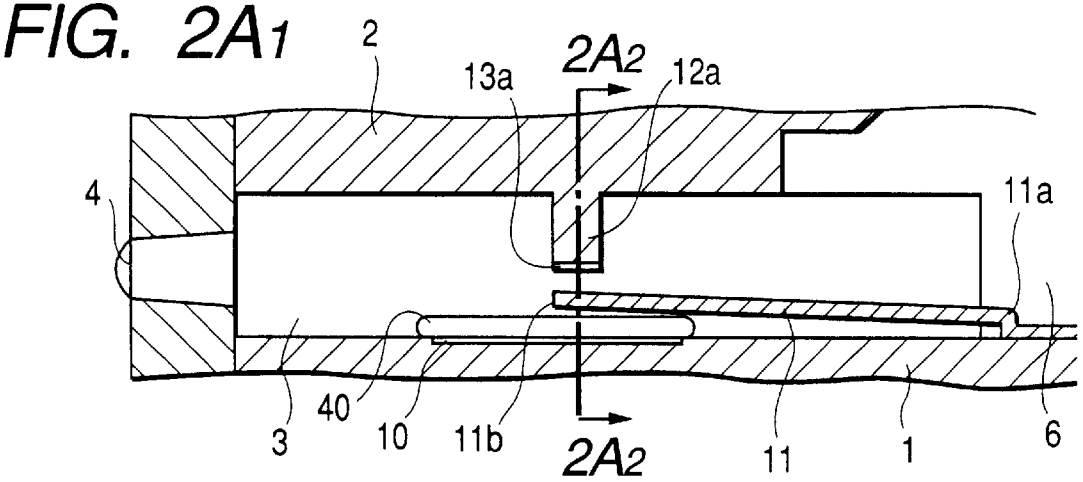
FIG. 2B1
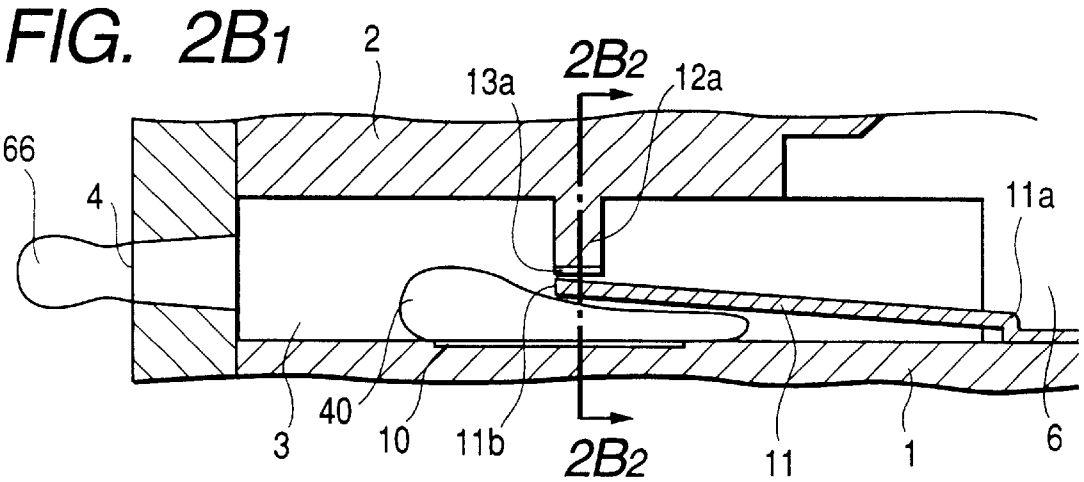

FIG. 3A2
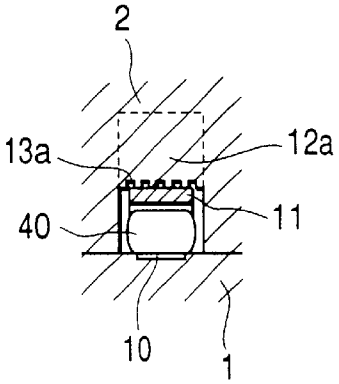
FIG. 3B2
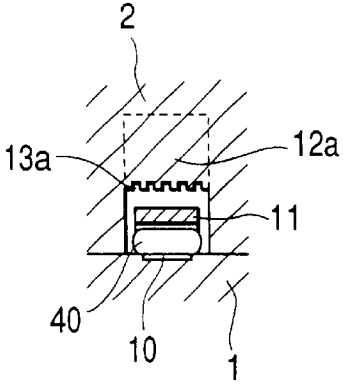
FIG. 3A1
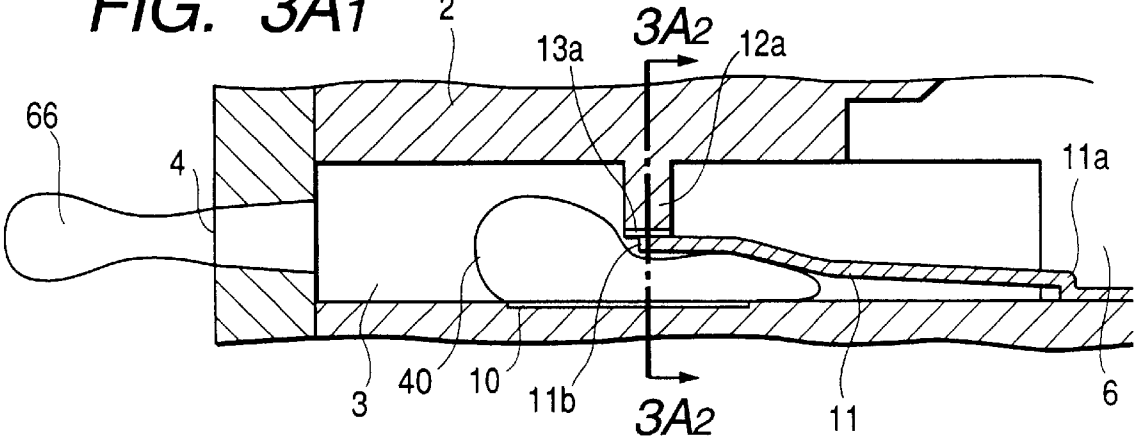
FIG. 3B1
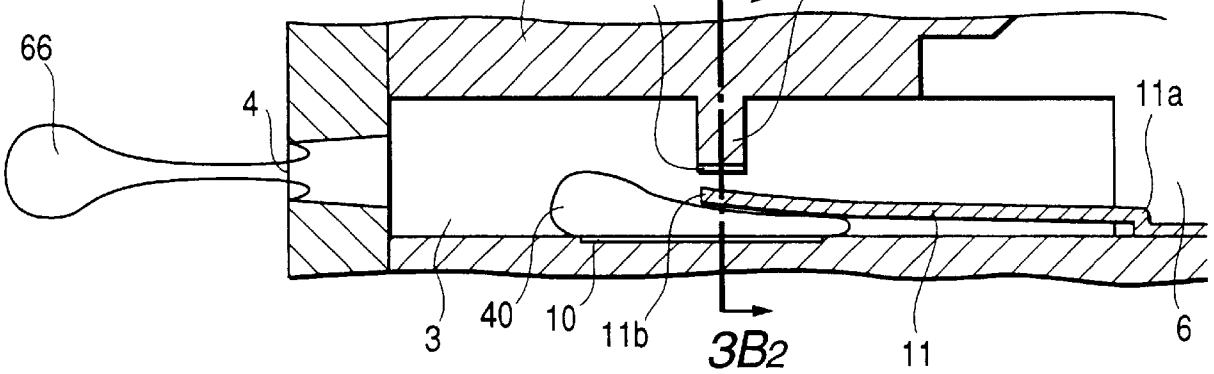

FIG. 15A2
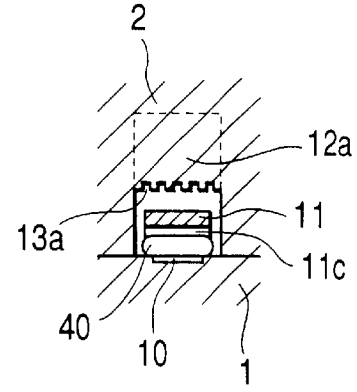
FIG. 15B2
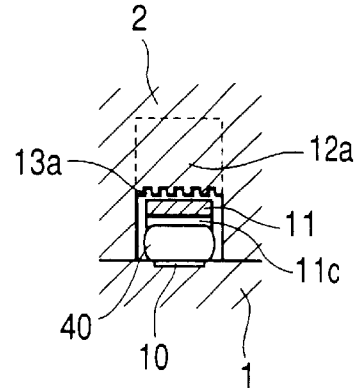
FIG. 15A1
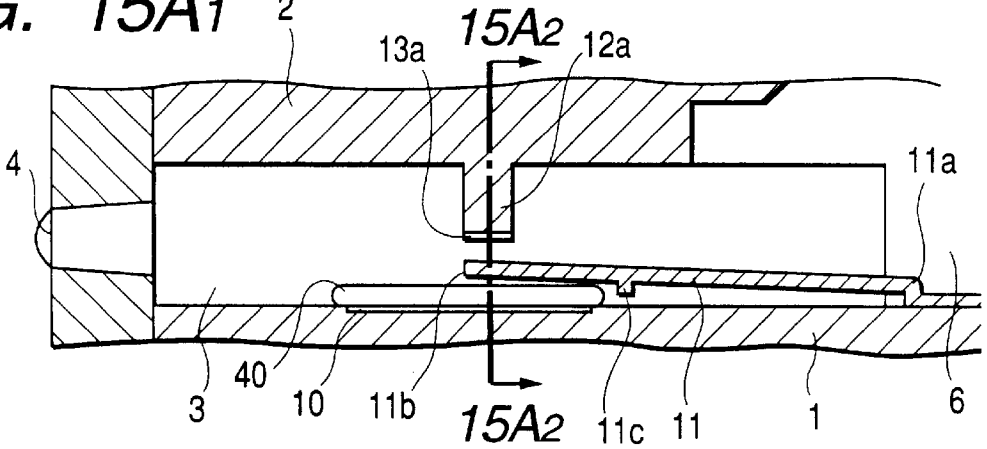
FIG. 15B1
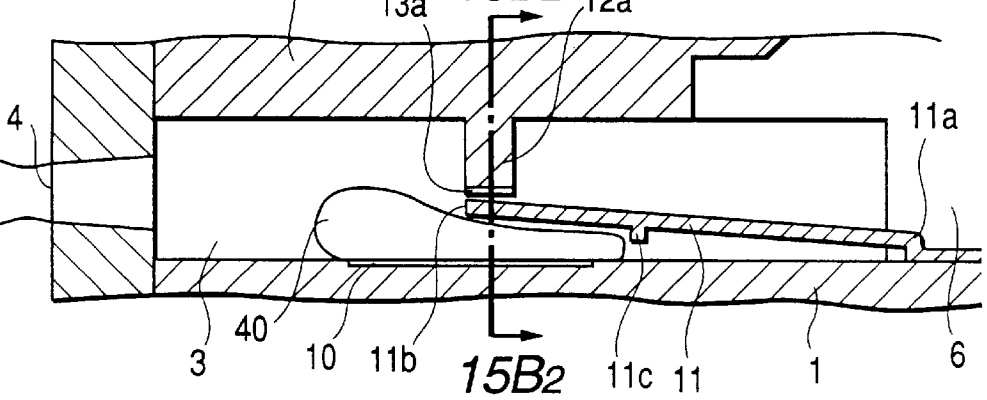

FIG. 16A2
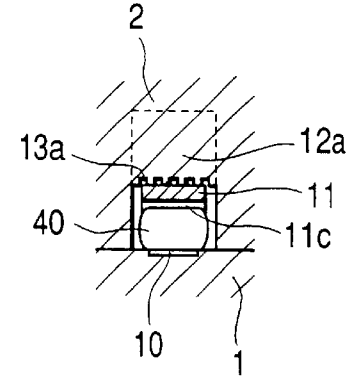
FIG. 16B2
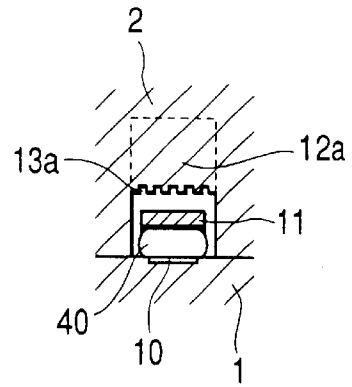
FIG. 16A1
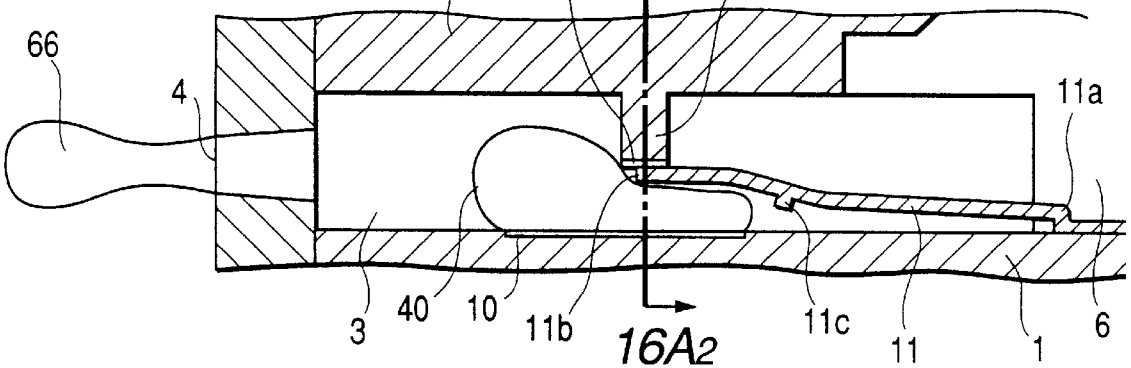
FIG. 16B1
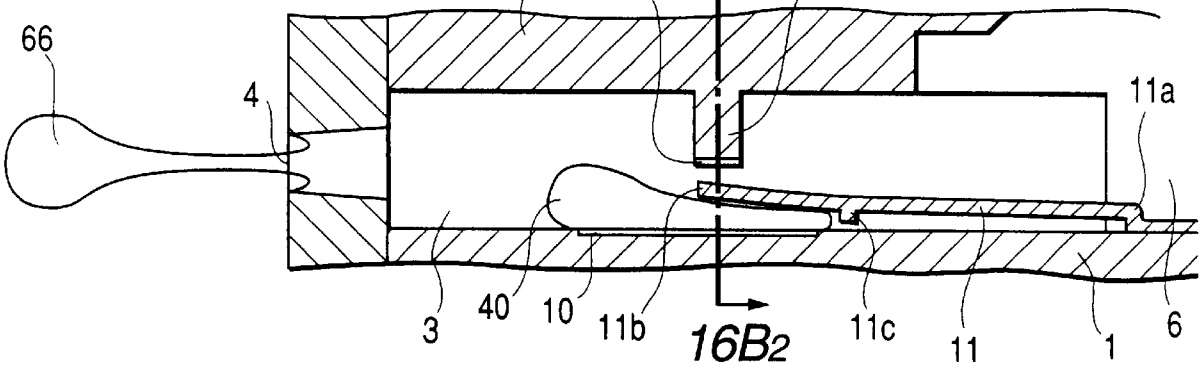

FIG. 18A2
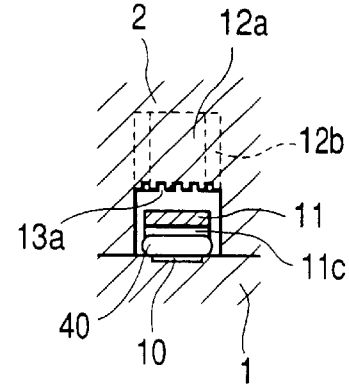
FIG. 18B2
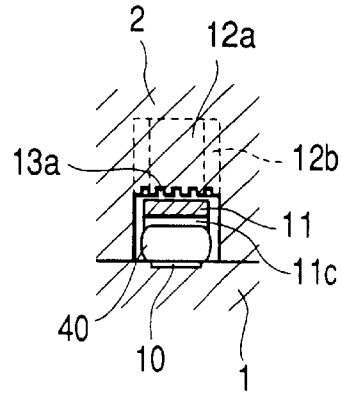
FIG. 18A1
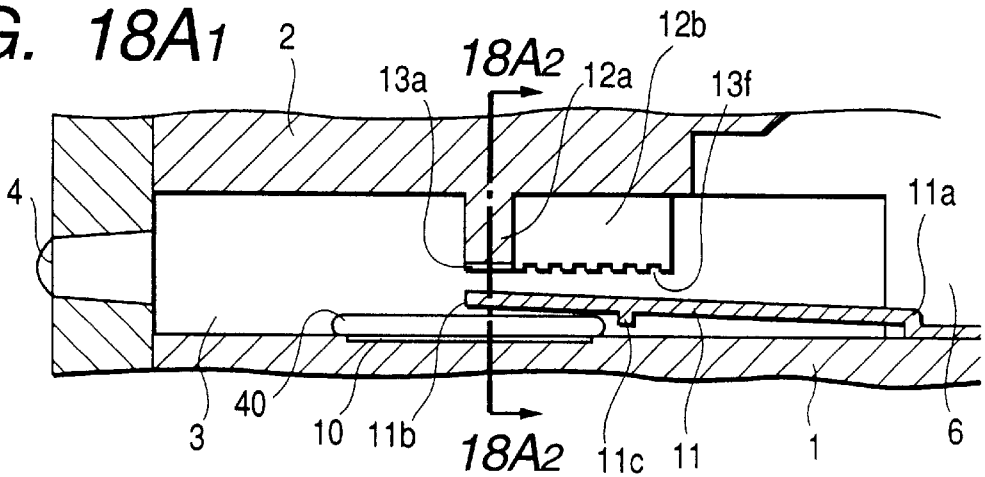
FIG. 18B1
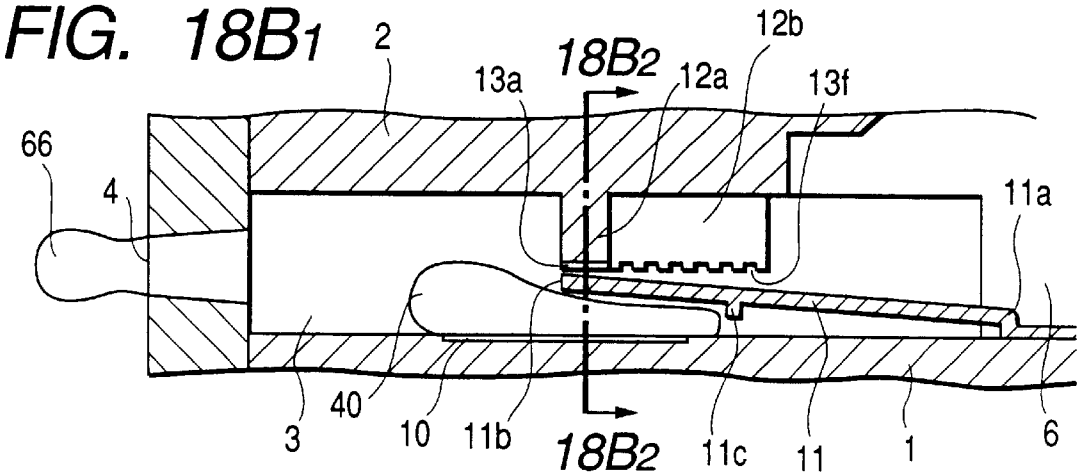

FIG. 19A2
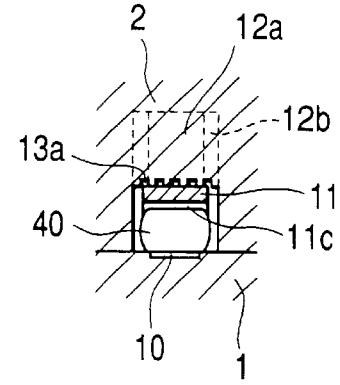
FIG. 19B2
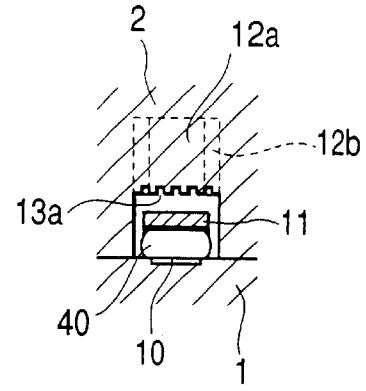
FIG. 19A1
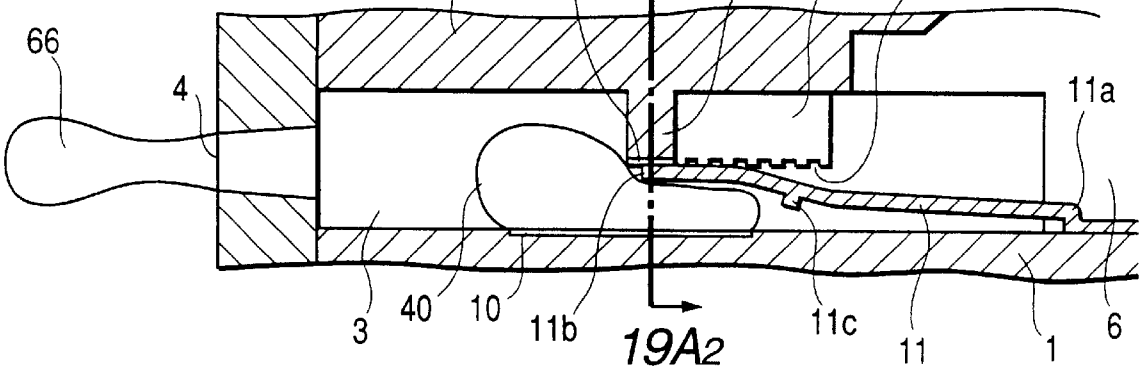
FIG. 19B1
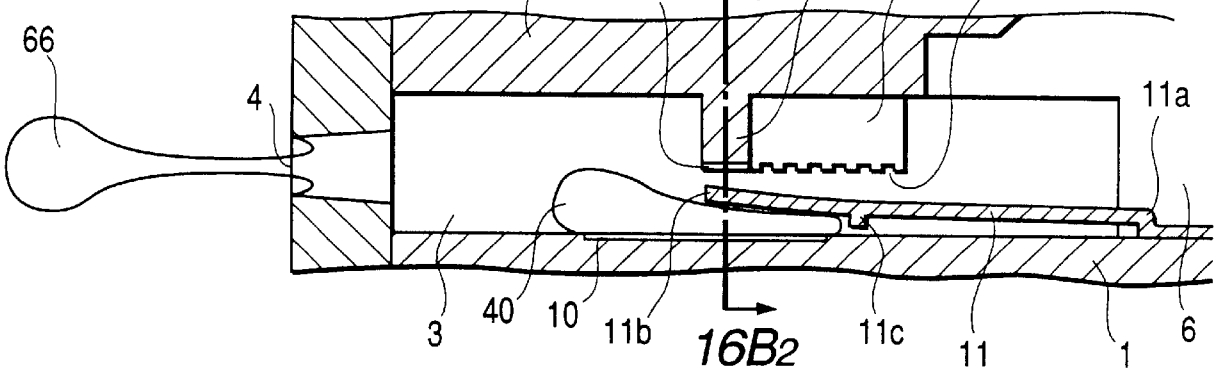

LIQUID DISCHARGE HEAD, HEAD CARTRIDGE AND LIQUID DISCHARGE APPARATUS

BACKGROUND OF THE INVENTION

1. Field of the Invention

The present invention relates to a liquid discharge head for applying thermal energy to liquid for generating a bubble therein thereby discharging the liquid, and a head cartridge and a liquid discharge apparatus having such liquid discharge head, and more particularly a liquid discharge head provided with a movable member capable of movement utilizing the bubble generation, and a head cartridge and a liquid discharge apparatus having such liquid discharge head.

In the present invention, "recording" means providing a recording medium not only with a meaningful image such as a character or graphic but also with a meaningless image such as a pattern.

2. Related Background Art

In the recording apparatus such as a printer, there is already known so-called bubble jet recording method, or an ink jet recording method in which for example thermal energy is given to liquid ink contained in a flow path to generate a bubble therein, and the ink is discharged from a discharge port by an action force based on a rapid volume change resulting from such bubble generation and is deposited on a recording medium to form an image. The recording apparatus utilizing such bubble jet recording method is generally provided, as disclosed in the U.S. Pat. No. 4,723,129, with a discharge port for discharging ink, a flow path communicating with the discharge port, and an electrothermal converting member constituting energy generation means for discharging ink contained in the flow path.

Such recording method, being capable of recording a high quality image at a high speed with a low noise level and also of arranging the discharge ports for ink discharge at a high density in the recording head for executing such recording method, has various advantages such as ability to recording an image of a high definition with a compact apparatus and to record a color image easily. Such bubble jet recording method is recently employed in various office equipment such as a printer, a copying apparatus, a facsimile apparatus etc. and even to industrial systems such as a print dyeing apparatus.

With such spreading of application of the bubble jet technology, there are being generated various requirements as explained in the following.

For obtaining an image of high quality, there are proposed a driving condition for realizing a liquid discharge method capable of providing a high ink discharge speed and achieving satisfactory ink discharge based on stable bubble generation, and an improved shape of the flow path for obtaining a liquid discharge head with a high liquid refiling speed into the flow path, in view of the high speed recording.

In addition to such head structures, the Japanese Patent Application Laid-Open No. 6-31918 takes into consideration a backward wave (pressure generated in a direction opposite to the direction toward the discharge port) and discloses a liquid discharge head of a structure capable of preventing the backward wave causing an energy loss at the ink discharge. In the liquid discharge head disclosed in the above-mentioned patent application, a triangular portion of a triangular plate-shaped member is positioned opposed to the heater for generating the bubble. In such liquid discharge head, the backward wave is temporarily and slightly suppressed by the plate-shaped member, but the relationship between the bubble growth and the triangular portion of the plate-shaped member is not at all disclosed nor considered, so that the above-mentioned liquid discharge head has the following drawbacks.

In the above-mentioned patent application, the shape of the liquid droplet cannot be stabilized since the heater is positioned in the bottom of a recess and is not in linear communication with the discharge port and the bubble growth from a side of the triangular plate-shaped member to the entire other side since the bubble growth is permitted from the vicinity of the apex of the triangular portion, whereby the bubble executes ordinary growth in the liquid as if the plate-shaped member is not present. Consequently the presence of the plate-shaped member does not affect at all the growth bubble. Inversely, since the plate-shaped member is entirely surrounded by the bubble, the liquid refill to the heater position at the bottom of the recess generates a random flow at the contraction of the bubble, thereby resulting in accumulation of small bubbles in the recess and disturbing the liquid discharge principle itself based on the bubble growth.

On the other hand, the EP laid-open No. 436047A1 discloses an invention of alternately opening a first valve for intercepting a path between an area in the vicinity of the discharge port and a bubble generating portion and a second valve for intercepting a path between the bubble generating portion and an ink supply portion (cf. FIGS. 4 to 9 in the EP laid-open No. 436047A1). In such invention, however, since only two of the three chambers are separated at a time, the ink discharged following the ink droplet forms a large trailing, whereby a satellite dots considerably increase in comparison with the ordinary liquid discharge method executing the bubble growth, bubble contraction and bubble vanishing. This is presumably because the effect of meniscus retraction by the vanishing of bubble cannot be utilized. Also at the liquid refilling, the liquid is supplied to the bubble generating portion by the bubble vanishing, but cannot be supplied to the area in the vicinity of the discharge port until a next bubble is generated, so that such liquid discharge head not only shows a large fluctuation in the discharged liquid droplet but also has a very low response frequency of liquid discharge, thus being not in the practical level.

The present applicant has made various proposals on a liquid discharge head different completely from the aforementioned liquid discharge head and having a movable member capable of effectively contributing to the liquid discharge droplet (for example a plate-shaped member of which a free end is positioned closer than the fulcrum thereof to the discharge port). Among such proposals, the Japanese Patent Application Laid-Open No. 9-48127 discloses a liquid discharge head capable of limiting the upper limit of displacement of the aforementioned movable member, in order to prevent a slight aberration in the behavior of such movable member. Also the Japanese Patent Application Laid-Open No. 9-323420 discloses a liquid discharge head in which the position of a common liquid chamber, formed at the upstream side of the aforementioned movable member, is shifted to the free end side thereof, namely to the downstream side, utilizing the advantage of the movable member, thereby improving the refilling ability.

As a liquid discharge head in which the displacement of the movable member is limited as disclosed in the aforementioned Japanese Patent Application Laid-Open No. 9-48127, the present applicant proposed a configuration in which a stopper, positioned close to the movable member displaced by the bubble generation, is provided so as to protrude from a position on an internal wall of the flow path and opposed to the free end side portion of the movable member, wherein the displacement of the movable member is limited by such stopper. In such liquid discharge head, however, when the movable member is displaced upward by the bubble generation in the liquid on the heater and approaches a contact plane with the movable member, the approaching speed of the movable member to the stopper is lowered by the presence of a liquid layer therebetween, thereby causing a liquid movement toward the upstream side in the flow path and deteriorating the response speed of the movable member.

SUMMARY OF THE INVENTION

The object of the present invention is to provide a liquid discharge head having a stopper as a limiting portion on the internal wall of a liquid flow path for limiting the displacement of a movable member, provided in the flow path, within a desired range, the liquid discharge head being capable of suppressing the movement of the liquid toward the upstream side in the flow path and preventing the loss in the response speed of the movable member when the movable member approaches the stopper by the bubble generation in the liquid contained in the flow path, thereby providing stable recording quality, and a head cartridge and a liquid discharge apparatus having such liquid discharge head.

The above-mentioned object can be attained, according to the present invention, by a liquid discharge head comprising a heat generating member for generating thermal energy for generating a bubble in the liquid, a discharge port constituting a portion for discharging the liquid, a liquid flow path communicating with the discharge port and including a bubble generating area for generating the bubble in the liquid, a movable member provided in the bubble generating area and adapted to displace with the growth of the bubble, and a limiting portion for limiting the displacement of the movable member within a desired range and adapted for discharging the liquid from the discharge port by the energy at the bubble generation by the heat generating member, wherein the limiting portion is provided opposed to the bubble generating area of the liquid flow path, and the movable member displaced by the bubble growth comes into a substantial contact with the limiting portion to separate the upstream side and the downstream side of the liquid flow path thereby forming a substantially closed state by the movable member and the limiting portion, and at least either of the surfaces of the movable member and the limiting portion is formed as a surface with irregularities.

According to the present invention, there is also provided a liquid discharge head comprising a heat generating member for generating thermal energy for generating a bubble in the liquid, a discharge port constituting a portion for discharging the liquid, a liquid flow path communicating with the discharge port and including a bubble generating area for generating the bubble in the liquid, a movable member provided in the bubble generating area and adapted to displace with the growth of the bubble, and a limiting portion for limiting the displacement of the movable member within a desired range and adapted for discharging the liquid from the discharge port by the energy at the bubble generation by the heat generating member, wherein the limiting portion is provided opposed to the bubble generating area of the liquid flow path, and the movable member displaced by the bubble growth comes into substantial contact with the limiting portion to separate the upstream side and the downstream side of the liquid flow path thereby forming a substantially closed state by the movable member and the limiting portion, and at least either of the surfaces of the movable member and the limiting portion is provided with a first exhaustion accelerating structure for exhausting the liquid, present in an area between the movable member and the limiting portion prior to the contact of the movable member and the limiting portion, to the exterior of such area.

More specifically, the first exhaustion accelerating structure is irregularities formed on at least either of the surfaces of the movable member and the limiting portion, where the movable member displaced by the bubble growth and the limiting portion come into substantial contact.

Preferably there is further comprised a side limiting portion of which at least a part comes into substantial contact with a side portion of the movable member displaced by the growth of the bubble.

Preferably there is further comprised a second exhaustion accelerating structure, on at least either of the surfaces of the movable member and the limiting portion, where the movable member displaced by the bubble growth and the limiting portion come into substantial contact, for exhausting the liquid present in an area between the movable member and the side limiting portion prior to the contact of the movable member and the side limiting portion, to the exterior of such area.

Preferably, the second exhaustion accelerating structure is irregularities formed on at least either of the surfaces of the movable member and the side limiting portion, where the movable member displaced by the bubble growth and the side limiting portion come into substantial contact.

Preferably the irregularities of the first and second exhaustion accelerating structures are constituted by forming a groove on the surface having such irregularities, and more preferably the irregularities are comb-tooth shaped. More preferably such irregularities of comb-tooth shape is constituted by forming plural grooves, extending along the direction of the liquid flow path, on the surface having such irregularities. More preferably, such plural grooves have a same length and are arranged in a zigzag manner in a direction perpendicular to the liquid flow path in such a manner that the two neighboring grooves have mutually different longitudinal positions.

Preferably the irregularities are constituted by forming island-shaped projections on the surface having the irregularities, or a recessed portion of the irregularities is constituted by a hole, of which an aperture end is preferably formed on a surface different from the surface having the irregularities.

According to the present invention described above, the limiting portion for limiting the displacement of the movable member within a desired range and the movable member come into substantial contact to separate the upstream side and the downstream side of the liquid flow path thereby forming a substantially closed state by the movable member and the limiting portion, and at least either of the surfaces of the movable member and the limiting portion is formed as a surface with irregularities and is provided with the first exhaustion accelerating mechanism, whereby the liquid present in the area between the limiting portion and the movable member at the approaching thereof to the limiting portion can be rapidly exhausted to the exterior of the area through the recessed portion of the irregularities. Also when the movable member is separated from the limiting portion, the liquid can be supplied to the area therebetween through the recessed portion of the irregularities. Consequently, at the displacement of the movable member, there is reduced the resistance to the movable member by the liquid layer present between the limiting portion and the movable member. Thus, at the displacement of the movable member toward the limiting portion by the bubble generation in the bubble generating area by the thermal energy from the heat generating member, there is shortened the time required by the movable member to contact the limiting portion. Such shortened time required by the movable member for contacting the limiting portion allows to suppress the liquid movement toward the upstream side in the flow path, thereby reducing the loss of bubble generating energy of the heat generating member. Also in case the movable member displaces in a direction farther from the limiting portion from a state a state where the movable member is in contact with or close to the limiting portion, there is also shortened the time required by the movable member for returning to the original position from the contact state with the limiting portion, and there can be prevented the deterioration in the response speed (response frequency) of the movable member. Furthermore, in the liquid discharging operation from the discharge port, there is suppressed the liquid movement to the upstream side in the liquid flow path, whereby the variation of the meniscus can be suppressed and the stable recording quality can be obtained from a low driving frequency to a high driving frequency.

Also in case the above-described liquid discharge head further comprises the side limiting portion of which at least a part comes into substantial contact with the side portion of the movable member displaced by the bubble growth, irregularities constituting a second exhaustion accelerating structure is formed on at least either of the surfaces of the movable member and the limiting portion, where the movable member and the limiting portion come into substantial contact, whereby the liquid present in the area between the limiting portion and the movable member at the approaching thereof to the limiting portion, prior to the contact thereof, can be exhausted to the exterior of the area. Also when the movable member is separated from the limiting portion, the liquid can be supplied to the area therebetween through the recessed portion of the irregularities. Consequently, at the displacement of the movable member, there is reduced the resistance to the movable member by the liquid layer present between the limiting portion and the movable member.

Also the head cartridge of the present invention comprises a liquid discharge head of any of the aforementioned configurations, and a liquid container for holding the liquid to be supplied to the liquid discharge head.

Also the liquid discharge apparatus of the present invention comprises a liquid discharge head of any of the aforementioned configuration, and drive signal supply means for supplying a drive signal for causing the liquid discharge head to discharge liquid.

Also the liquid discharge apparatus of the present invention comprises a liquid discharge head of any of the aforementioned configuration, and recording medium conveying means for conveying a recording medium for receiving the liquid discharged from the liquid discharge head.

Such liquid discharge apparatus executes recording by discharge liquid from the liquid discharge head and depositing the liquid onto the recording medium.

BRIEF DESCRIPTION OF THE DRAWINGS

FIGS. 2A1, 2A2, 2B1 and 2B2 are views showing the discharging operation of the liquid discharge head shown in FIGS. 1A, 1B and 1C;

FIGS. 3A1, 3A2, 3B1 and 3B2 are views showing the discharging operation of the liquid discharge head shown in FIGS. 1A, 1B and 1C;

FIGS. 15A1, 15A2, 15B1, 15B2, 16A1, 16A2, 16B1 and 16B2 are views showing the discharging operation of the liquid discharge head shown in FIG. 13;

FIGS. 18A1, 18A2, 18B1, 18B2, 19A1, 19A2, 19B1 and 19B2 are views showing the discharging operation of the liquid discharge head shown in FIGS. 17A, 17B, 17C and 17D;

DESCRIPTION OF THE PREFERRED EMBODIMENTS

Now the present invention will be clarified in detail by preferred embodiments thereof, with reference to the accompanying drawings.

First Embodiment

Figure 1C:
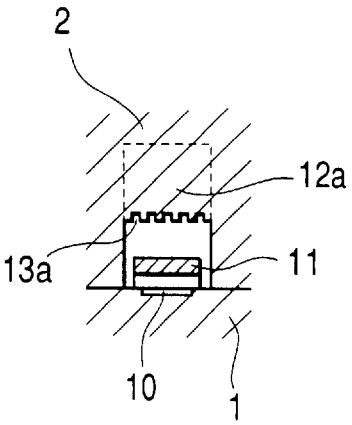
FIGS. 1A, 1B and 1C are cross sectional views showing a liquid discharge head constituting a first embodiment of the present invention.
Figure 1A:
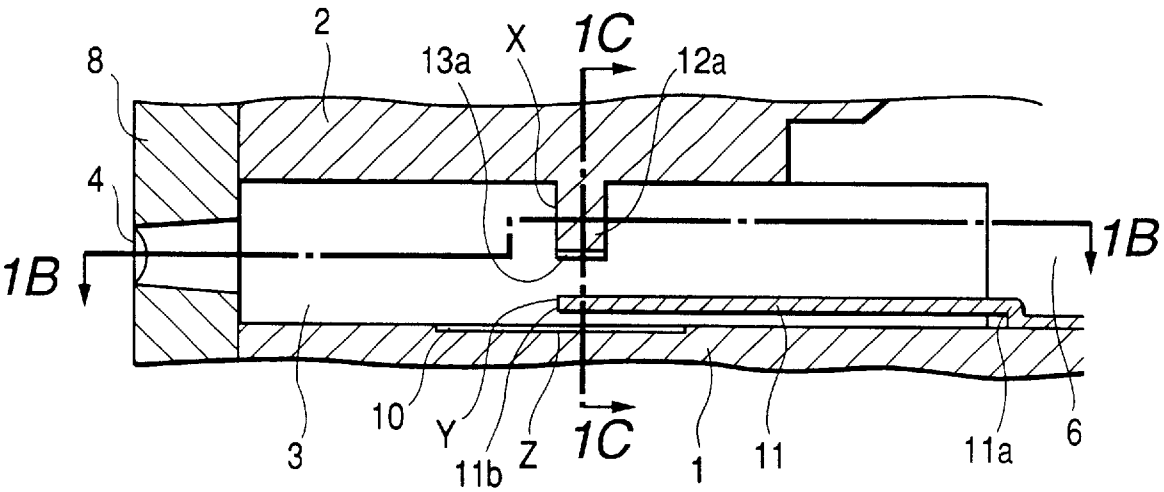
Figure 1B:
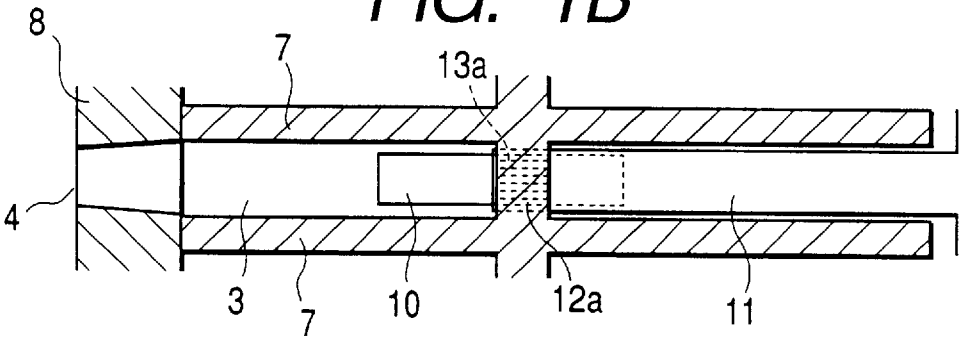

FIGS. 1A to 1C are cross-sectional views showing a liquid discharge head constituting a first embodiment of the present invention, wherein FIG. 1A is a cross-sectional view thereof along the liquid flow path, FIG. 1B is a cross-sectional view along a line 1B—1B in FIG. 1A and FIG. 1C is a cross-sectional view along a line 1C—1C in FIG. 1A. As shown in these drawings, the liquid discharge head of the present embodiment is provided with an element substrate 1 bearing an array of plural heat generating members 10 (only one being illustrated) as energy generating elements for providing liquid with thermal energy for generating bubbles therein, a top plate 2 fixed in a laminated state on the element substrate 1, and an orifice plate 8 adjoined to the front end face of the element substrate 1 and the top plate 2. Between the element substrate 1 and the top plate 2 there are provided plural liquid flow paths 3 and a common liquid chamber 6 of a large volume to which the liquid flow paths 3 communicate. Each liquid flow path 3 has an oblong form defined by the element substrate 1, side walls 7 and the top plate (counter plate) 2, and a large number of the liquid flow paths 3 are formed in a liquid discharge head. At the upstream side, these plural liquid flow paths 3 commonly communicate with the common liquid chamber 6. Thus the plural liquid flow paths 3 are branched from the common liquid chamber 6. The height of the common liquid chamber 6 is made much larger than that of the liquid flow path 3. Also corresponding to each of the plural liquid flow paths 3, the element substrate 1 is provided with a heat generating member (bubble generating means) 10 such as an electrothermal converting element, and the element substrate 1 is provided, on a surface thereof bearing the heat generating members 10, with movable members 11 respectively corresponding to the heat generating members 10. A portion on the heat generating member 10 in the liquid flow path 3 constitutes a bubble generating area for generating a bubble, by the heat generating member 10, in the liquid ink present in the liquid flow path 3.

The movable member 11 is formed as a beam supported at an end, and is fixed to the element substrate 1 at the upstream side of the ink flow in the liquid flow path 3 (at the right-hand side in FIG. 1A). The connecting portion of the movable member 11 to the element substrate 1 constitutes a fulcrum 11*a*, and a portion of the movable member 11 in the downstream side (left-hand side in FIG. 1A) with respect to the fulcrum 11*a* is rendered vertically movable with respect to the element substrate 1. In an initial position shown in FIG. 1A, the movable member 11 is positioned parallel to the element substrate 1, with a small gap thereto.

Further in the present embodiment, the movable member 11 is so positioned that the free end 11*b* thereof is positioned at an approximately central area of the heat generating member 10 along the liquid flow path, whereby the downstream portion of the movable member 11 is positioned in the bubble generating area on the heat generating member 10. Above the free end 11*b* of the movable member 11, namely opposite to the heat generating member 10, there is provided a front end stopper 12*a* constituting a limiting portion for limiting the upward displacement of the movable member 11. on a surface of the front end stopper 12*a*, at the side of the movable member 11, namely a surface of the front end stopper 12*a* where the movable member 11 comes into substantial contact, there are formed recesses constituted as grooves 13*a* extending along the direction of the liquid flow path 13. As a result of formation of such plural grooves 13*a*, a portion between the two adjacent grooves 13*a* constitutes a protruding portion, whereby irregularities are formed as a first exhaustion accelerating structure on the surface of the front end stopper 12*a* at the side of the movable member 11.

Figure 4:
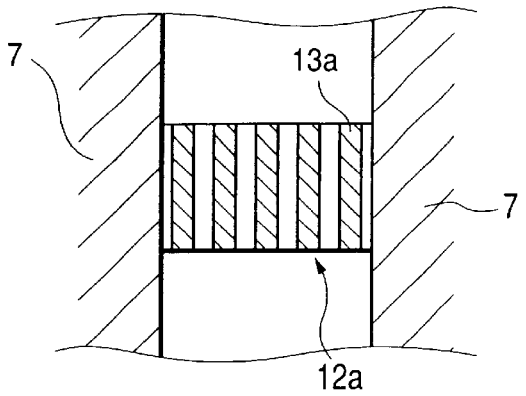
FIG. 4 is a plan view of a front end stopper shown in FIGS. 1A, 1B and 1C, seen from the side of an element substrate.

FIG. 4 is a plan view of the front end stopper 12*a* shown in FIGS. 1A to 1C, seen from the side of the element substrate 1. In FIG. 4, each of the plural grooves 13*a* formed on the surface of the front end stopper 12*a* at the side of the movable member 11 is indicated by hatching. As shown in FIG. 4, each of the plural grooves 13*a* extends, along the liquid flow path 3, from an end face of the front end stopper 12*a* at the side of the common liquid chamber 6 to an end face at the side of the discharge port 4. By the formation of such plural grooves 13*a*, the surface of the front end stopper 12*a* at the side of the movable member 11 constitutes comb-tooth shaped irregularities.

The presence of the plural grooves 13*a* in the contact surface of the front end stopper 12*a* with the movable member 11 allows, when the movable member 11 is displaced by the bubble generated in the ink on the heat generating member 10 and approaches the surface of the front end stopper 12*a* having the grooves 13*a*, the ink present in the area between the front end stopper 12*a* and the movable member 11 to be promptly exhausted to the upstream and downstream sides through the grooves 13*a*, whereby the movable member 11 can attain a satisfactory contact state with the front end stopper 12*a* and can maintain the bubble generating area in a substantially closed state. The width of the grooves 13*a* is selected that, in such state, the bubble does not reach the upstream side of the front end stopper 12*a* but is contained therein. Also in case the movable member 11 is displaced in a direction farther from the front end stopper 12*a*, from a state where the movable member 11 is in contact with or close to the front end stopper 12*a*, the ink is supplied through the grooves 13*a* to the area between the front end stopper 12*a* and the movable member 11. Then, when the movable member 11 approaches the front end stopper 12*a* or moves away therefrom, there is reduced the resistance to the movable member 11 by the liquid layer present between the front end stopper 12*a* and the movable member 11. Consequently there are shortened the time required by the movable member 11 to contact the front end stopper 11*a* and the time required by the movable member 11 to be separated from the front end stopper 12*a* and to return to the initial position.

As a result, when the movable member 11 approaches the front end stopper 12*a*, the movement of the liquid to the upstream side in the liquid flow path can be suppressed, and the loss in the response speed (response frequency) of the movable member 11 can be prevented. Also in the ink discharging operation from the discharge port 4, a substantially closed state is formed by the movable member 11, the front end stopper 12*a*, the top plate 2 and the element substrate 1 to separate the upstream side and the downstream side of the liquid flow path 3, thereby suppressing the liquid movement toward the upstream side in the liquid flow path 3 to suppress the vibration of the meniscus and to provide stable recording quality from a low driving frequency to a high driving frequency. In such ink discharging operation, there is also reduced the loss of the bubble generating energy generated by the heat generating member 10. Also there can be provided a liquid discharge head capable of high speed recording, since the response frequency of the movable member 11 can be elevated to increase the driving frequency of the liquid discharge head.

Also, a front end face Y of the free end 11*b* of the movable member 11 and an end face X of the front end stopper 12*a* at the side of the discharge port 4 are preferably positioned on a place perpendicular to the element substrate 1. More preferably, the front end face Y and the end face X are positioned, together with a center Z of the heat generating member 10 in the longitudinal direction of the liquid flow path 3, on a place perpendicular to the element substrate 1.

Further, in the liquid discharge head of the present embodiment, the height of the liquid flow path 3 suddenly increases in a portion at the downstream side of the front end stopper 12*a*. With such configuration, the downstream portion of the bubble generated in the bubble generating area on the heat generating member 10 is not prevented from growth because of such sufficient flow path height even after the movable member 11 is limited by the front end stopper 12*a*, whereby the liquid can be smoothly guided toward the discharge port 4. Besides, the unevenness in the pressure balance in the direction of height from the lower end to the higher end of the discharge port 4 can be reduced, whereby satisfactory liquid discharge can be attained. In case such flow path configuration with the suddenly increasing height is adopted in the conventional liquid discharge head without the movable member, a stagnation is generated in the portion where the flow path height suddenly increase at the downstream side and the bubble tends to be undesirably trapped in such portion, but, in the configuration of the present embodiment, the bubble stagnation becomes extremely little because the liquid flow reaches even to such portion.

Also the ceiling at the side of the common liquid chamber 6 is made suddenly higher. In such configuration of the common liquid chamber 6 without the movable member 11, the discharging pressure is not easily guided toward the discharge port 4 because the fluid resistance at the upstream side of the bubble generating area becomes lower than that at the downstream side, but, in the present embodiment, as the bubble movement toward the upstream side of the bubble generating area is substantially intercepted by the movable member 11 and as the fluid resistance at the upstream side of the bubble generating area is reduced at the ink supplying operation, the ink supply can be promptly achieved to the bubble generating area.

In the present embodiment, the downstream portion of the bubble and the discharge port are in a "straight communicating state" having a straight flow path structure to the liquid flow. Such situation is desirable in realizing an ideal state where the propagating direction of the pressure wave generated at the bubble generation, the flowing direction of the liquid resulting therefrom and the liquid discharging direction are made to mutually coincide linearly to stabilize the discharging direction of the liquid droplet from the discharge port 4 and the discharge speed thereof at a very high level. In the present invention, such ideal state can be realized or approximated by a configuration in which the discharge port 4 and the heat generating member 10, particularly a portion thereof at the side of the discharge port 4 (namely at the downstream side) influencing the portion of the bubble at the side of the discharge port 4, are directly connected by a straight line, and such configuration can be confirmed by a situation in which, in the absence of the liquid in the flow path 3, the heat generating member 10, particularly the downstream side thereof, can be observed through the discharge port 4 from the outside thereof.

In the following there will be explained the discharging function of the liquid discharge head of the present embodiment, with reference to FIGS. 1A to 3B2. FIGS. 2A1 to 3B2 are views showing the discharge operation of the liquid discharge head shown in FIGS. 1A to 1C, wherein FIGS. 2A1, 2B1, 3A1 and 3B1 are cross-sectional views of the liquid discharge head along the liquid flow path, FIG. 2A2 is a cross-sectional view along a line 2A2—2A2 in FIG. 2A1, FIG. 2B2 is a cross-sectional view along a line 2B2—2B2 in FIG. 2B1, FIG. 3A2 is a cross-sectional view along a line 3A2—3A2 in FIG. 3A1, and FIG. 3B2 is a cross-sectional view along a line 3B2—3B2 in FIG. 3B1.

FIGS. 1A to 1C show a state prior to the application of energy, such as electrical energy, to the heat generating member 10, thus prior to the heat generation thereof. In this state it is to be noted that the width of the movable member 11 is smaller than the width of the liquid flow path 3 to secure a clearance to the side wall 7 which is a liquid flow path wall, also that the movable member 11 is opposed to the upstream half of the bubble generated by the heat generation of the heat generating member 10, and that the front end stopper 12*a* for limiting the displacement of the movable member 11 is provided on the internal wall of the liquid flow path 3. The front end stopper 12*a* limits the upward displacement of the movable member 11, and the movable member 11 comes into contact with the front end stopper 12*a*, in limiting the upward displacement of the movable member 11, thereby suppressing the liquid movement from the bubble generating area toward the upstream side.

FIGS. 2A1 and 2A2 show a state where a part of the liquid in the bubble generating area on the heat generating member 10 is heated whereby a bubble 40 starts to be generated by film boiling. In the state shown in FIGS. 2A1 and 2A2, a pressure wave based on the generation of the bubble 40 by the film boiling phenomenon propagates in the liquid flow path 3, whereby the liquid moves to the upstream and downstream sides with a boundary at the central portion of the bubble generating area. Thus, at the upstream side, the movable member 11 starts to displace by the liquid flow resulting from the growth of the bubble 40. Also a certain flow of the liquid to the upstream side moves toward the common liquid chamber 6 through the gap between the movable member 11 and the side wall 7.

FIGS. 2B1 and 2B2 show a state where the movable member 11 displaces larger than in FIGS. 2A1 and 2A2 and is positioned close to the front end stopper 12*a*. In such state, the liquid moves further by the generation of the bubble 40 whereby the movable member 11 comes close to the front end stopper 12*a* at the upstream side of the bubble generating area, and a liquid droplet 66 is being discharged from the discharge port 4 at the downstream side.

In this state, since the clearance between the front end stopper 12*a* and the movable member 11 is small, the passing of the liquid from the bubble generating area to the upstream side, namely toward the common liquid chamber 6, is considerably restricted. As a result, there is generated a large pressure difference, at the movable member 11, between the bubble generating area and the common liquid chamber 6 whereby the portion of the movable member 11 at the side of the free end 11*b* is pressed closely to the front end stopper 12*a*.

A part of the ink present in the area between the front end stopper 12*a* and the movable member 11 is discharged from such area through the grooves 13*a* formed on the front end stopper 12*a* and constituting a discharge path. Thus, at the displacement of the movable member 11 toward the front end stopper 12*a*, there is reduced the resistance to the movable member 11 by the liquid layer present between the front end stopper 12*a* and the movable member 11, whereby movable member 11 displaces rapidly. Thus, in comparison with a case without the grooves 13*a* on the front end stopper 12*a*, there is shortened the time required by the movable member 11 to contact the front end stopper 12*a* whereby the ink movement to the upstream side in this stage in the liquid flow path 3 is suppressed and the loss of the bubble generating energy from the heat generating member 10 is reduced.

FIGS. 3A1 and 3A2 show a state where the movable member 11 displaces to a position in contact with or close to the front end stopper 12*a* and is prevented from further upward displacement at the front end, whereby the liquid movement toward the upstream side is also significantly restricted. However, since the moving force of the liquid toward the upstream side is large, the movable member 11 is subjected to a stress toward the upstream side and generates a slight deformation convex to the above. As the bubble 40 still continues to grow in such state, the growth of the bubble 40 in the upstream component thereof, being restricted by the movable member 11, tends to be directed toward the downstream side of the bubble. Therefore, in comparison with a case without the movable member, the growing height of the bubble becomes larger toward the downstream side of the heat generating member.

On the other hand, as the displacement of the movable member 11 is limited by the front end stopper 12*a* as explained in the foregoing, the upstream portion of the bubble 40 remains at a small size, in a state of bending the movable member 11 toward the upstream side by the inertial force of the liquid flow toward the upstream side and charging the stress in the movable member 11. Such configuration significantly restricts the liquid flow toward the upstream side, thereby preventing the fluid crosstalk to the adjacent liquid flow paths and the reverse liquid flow or the pressure vibration in the liquid supply system inhibiting the high speed refiling.

FIGS. 3B1 and 3B2 show a state where the internal negative pressure of the bubble 40 overcomes the liquid movement to the downstream side in the liquid flow path 3 after the aforementioned film boiling, whereby the bubble 40 starts to contact.

In this state the movable member 11 displaces downward by the contraction of the bubble 40, and the velocity of such downward displacement is increased by the spring force of the movable member 11 itself and by the aforementioned stress of the upward convex deformation. The resulting liquid flow in the area of low flow path resistance to the downstream side rapidly grows to a large current because of the flow path resistance, and goes into the liquid flow path 3 through the gap between the front end stopper 12*a* and the movable member 11. By these operations, the liquid is guided from the common liquid chamber 6 into the liquid flow path 3. The liquid guided into the liquid flow path 3 enters the downstream side of the heat generating member 10 through the gap between the front end stopper 12*a* and the downward moving movable member 11 and so acts as to accelerate the vanishing of the bubble 40 which has not yet completely vanished. After accelerating the vanishing of the bubble, the liquid flow increases the flow toward the discharge port 4, thereby assisting the restoration of the meniscus and thus improving the refilling speed.

Also the aforementioned liquid flow into the liquid flow path 3 through the gap between the movable member 11 and the front end stopper 12*a* increases the flow speed in the flow path 3 at the side of the top plate 2 as shown in FIGS. 3A1 and 3A2, thereby extremely reducing the remnant microbubbles in such area and stabilizing the liquid discharge.

If the gap between the front end stopper 12*a* and the movable member 11 is small in the downward displacement thereof away from the front end stopper 12*a*, the ink present in the vicinity of the grooves 13*a* of the front end stopper 12*a* is supplied through such grooves 13*a* to the area between the front end stopper 12*a* and the movable member 11. Therefore, when the movable member 11 leaves a state where it is in contact with or close to the front end stopper 12*a* and returns to the initial position, the resistance to the movable member 11 is suppressed whereby it can rapidly displace. Thus, in comparison with a case of absence of the grooves 13*a* on the front end stopper 12*a*, thereby is shortened the time required by the movable member 11 to lease the front end stopper 12*a* and to return to the initial position.

As explained in the foregoing, in the liquid discharge head of the present embodiment, in comparison with a case without the grooves 13*a* on the front end stopper 12*a*, there are shortened the time required by the movable member 11 to contact the front end stopper 12*a* and the time required by the movable member 11 to return from the front end stopper 12*a* to the initial position, whereby prevented is the loss of the response speed (response frequency) of the movable member 11, resulting from the presence of the front end stopper 12*a* in the liquid flow path 3.

Figure 5:
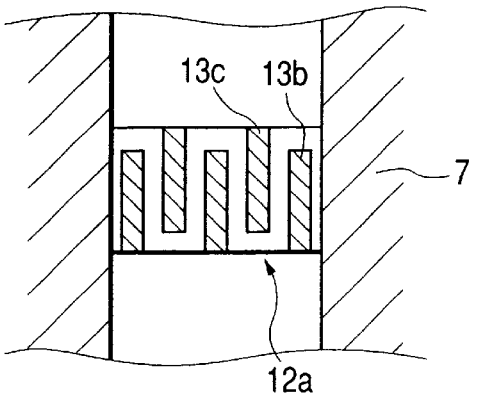
FIGS. 5, 6 and 7 are plan views showing variations of the front end stopper shown in FIGS. 1A, 1B and 1C.
Figure 6:
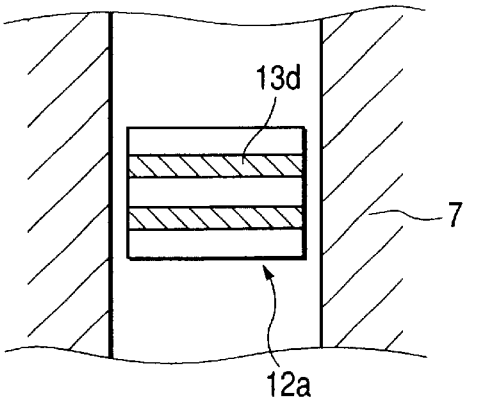
Figure 7:
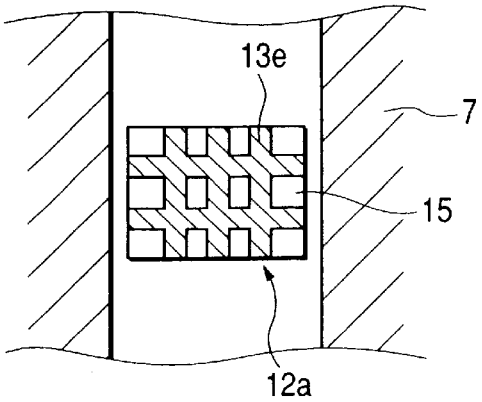

FIGS. 5 to 7 are plan views showing variations of the front end stopper 12*a* shown in FIGS. 1A to 1C, wherein the grooves formed on the front end stopper 12*a* are indicated by hatching.

In a variation shown in FIG. 5, there are provided, on a surface of the front end stopper 12*a* opposed to the movable member 11, a groove 13*b* extending along the direction of the liquid flow path from the end face of the front end stopper 12*a* at the side of the discharge port 4 to the vicinity of the end face of the front end stopper 12*a* at the side of the common liquid chamber 6, and a groove 13*c* extending along the direction of the liquid flow path from the end face of the front end stopper 12*a* at the side of the common liquid chamber 6 to the vicinity of an end face of the front end stopper 12*a* at the side of the discharge port 4, each in plural units. The grooves 13*b*, 13*c* have a same length and a same width, and are alternately arranged in a direction perpendicular to the direction of the liquid flow path 3. Consequently, in the movable member 11, the grooves 13*b*, 13*c* are arranged in zigzag manner that the two adjacent grooves 13*b*, 13*c* are different in the longitudinal position.

In a variation of the front end stopper 12*a* shown in FIG. 6, gaps are formed between the front end stopper 12*a* and the side walls 7 on both sides, and a groove 13*d* extending perpendicularly to the direction of the liquid flow path 3 is formed in plural units on the surface of the front end stopper 12*a* opposed to the movable member 11. As indicated above, the front end stopper 12*a* need not be formed over the entire width of the liquid flow path 3 but may have a gap to the side wall 7 with an extent that the liquid flow from the downstream side to the upstream side is not generated. It is however preferred, as indicated in the variation shown in FIG. 5, that the grooves 13*b*, 13*c* constituting the discharge paths do not communicate with both the upstream side and the downstream side, and that the front end stopper 12*a* and the side wall 7 do not have a gap therebetween.

In a variation of the front end stopper 12*a* shown in FIG. 7, gaps are formed between the front end stopper 12*a* and the side walls 7 on both sides, and grooves 13*e* in a grid pattern are on the surface of the front end stopper 12*a* opposed to the movable member 11, thereby forming plural island-shaped projections 15 thereon. The plural island-shaped projections 15 form irregularities on the face of the front end stopper 12*a* opposed to the movable member 11. The liquid discharge head of such configuration has a high effect of discharging the ink present between the movable member 11 and the front end stopper 12*a*.

Second Embodiment

Figure 8:
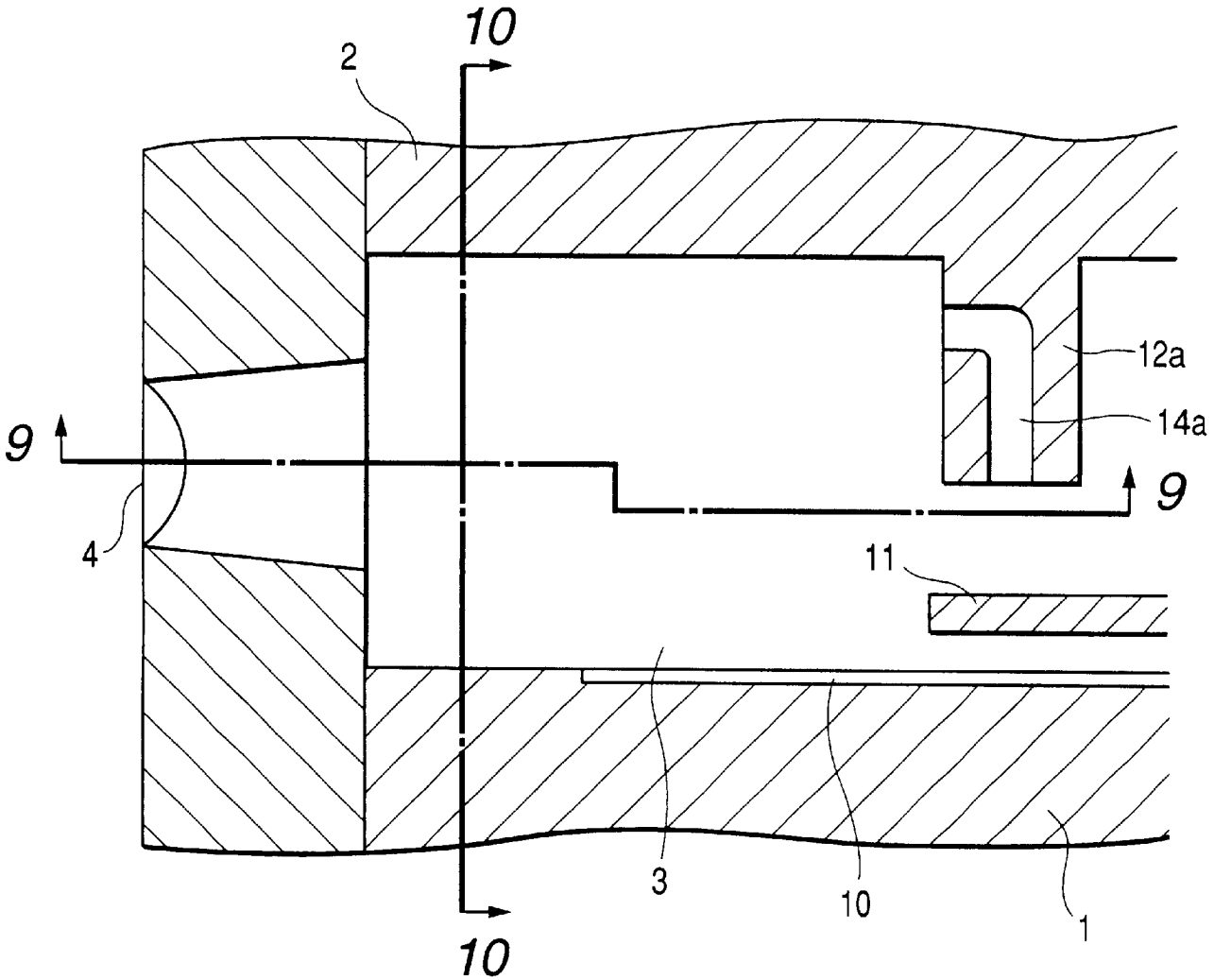
FIG. 8 is a cross-sectional view showing a liquid discharge head of a second embodiment of the present invention.
Figure 9:
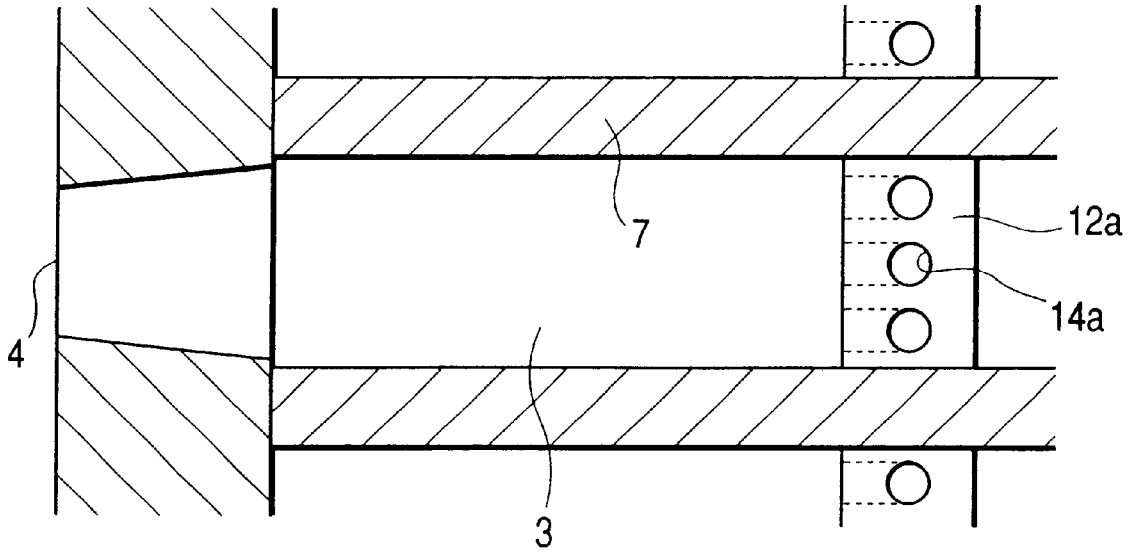
FIG. 9 is a cross-sectional view along a line 9—9 in FIG. 8.
Figure 10:
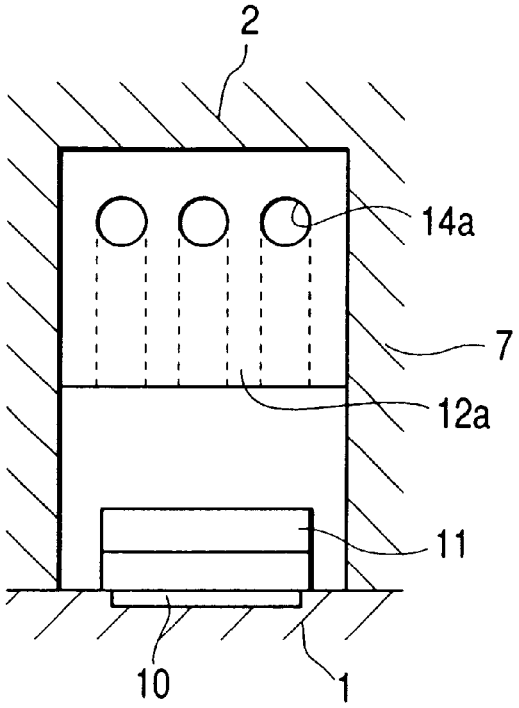
FIG. 10 is a cross-sectional view along a line 10—10 in FIG. 8.

FIG. 8 is a cross-sectional view showing a liquid discharge head of a second embodiment of the present invention, while FIG. 9 is a cross-sectional view along a lien 9—9 in FIG. 8, and FIG. 10 is a cross-sectional view along a line 10—10 in FIG. 8. The liquid discharge head of the present embodiment, in comparison with that of the first embodiment, is principally different in that a liquid flow path is formed within the front end stopper for limiting the displacement of the movable member. In FIGS. 8 to 10, components same as those in the first embodiment are represented by same numbers. In the following there are principally explained points different from the first embodiment.

As shown in FIGS. 8 to 10, plural liquid flow paths 14*a* are formed inside the front end stopper 12*a*, and an end of each liquid flow path 14*a* is opened on the face of the front end stopper 12*a* opposed to the movable member 11 while the other end opens on the face of the front end stopper 12*a* at the side of the discharge port 4. Consequently, in the liquid discharge head of the present embodiment, the face of the front end stopper 12*a* opposed to the movable member 11 is provided with holes constituting recesses serving as the first discharging structure and also constituting the liquid flow paths 14*a*.

In such liquid discharge head, when the movable member 11 displaces toward the front end stopper 12*a*, a part of the ink present in the area between the front end stopper 12*a* and the movable member 11 is discharged through the liquid flow paths 14*a* and through the open ends thereof at the side of the discharge port 4 to the downstream side of the liquid flow path 3. Also when the movable member 11 displaces away from the front end stopper 12*a* from a state in contact therewith or close thereto, the ink present close to the front end stopper 12*a* at the side of the discharge port 4 is supplied, through the liquid flow paths 14*a* from the ends thereof at the side of the discharge port 4, to the area between the front end stopper 12*a* and the movable member 11.

Therefore, in the ink discharging operation, there can be reduced the loss of the bubble generating energy from the heat generating member 10. Also, as in the liquid discharge head of the first embodiment having the grooves on the front end stopper 12*a*, there ca be reduced the resistance by the liquid layer present between the front end stopper 12*a* and the movable member 11 when the movable member 11 displaces toward the front end stopper 12*a* by the bubble generation and when the movable member 11 displaces away from the front end stopper 12*a*. As a result, there can be reduced the time required by the movable member 11 for contacting the front end stopper 12*a* and the time required by the movable member 11 for returning from the front end stopper 12*a* to the initial position, whereby the deterioration in the response speed (response frequency) of the movable member 11 can be prevented. Also the present embodiment provides a higher effect of separating the upstream and downstream sides, because of the absence, in the front end stopper 12*a*, of the grooves communicating with the upstream and downstream sides of the liquid flow path.

Figure 11:
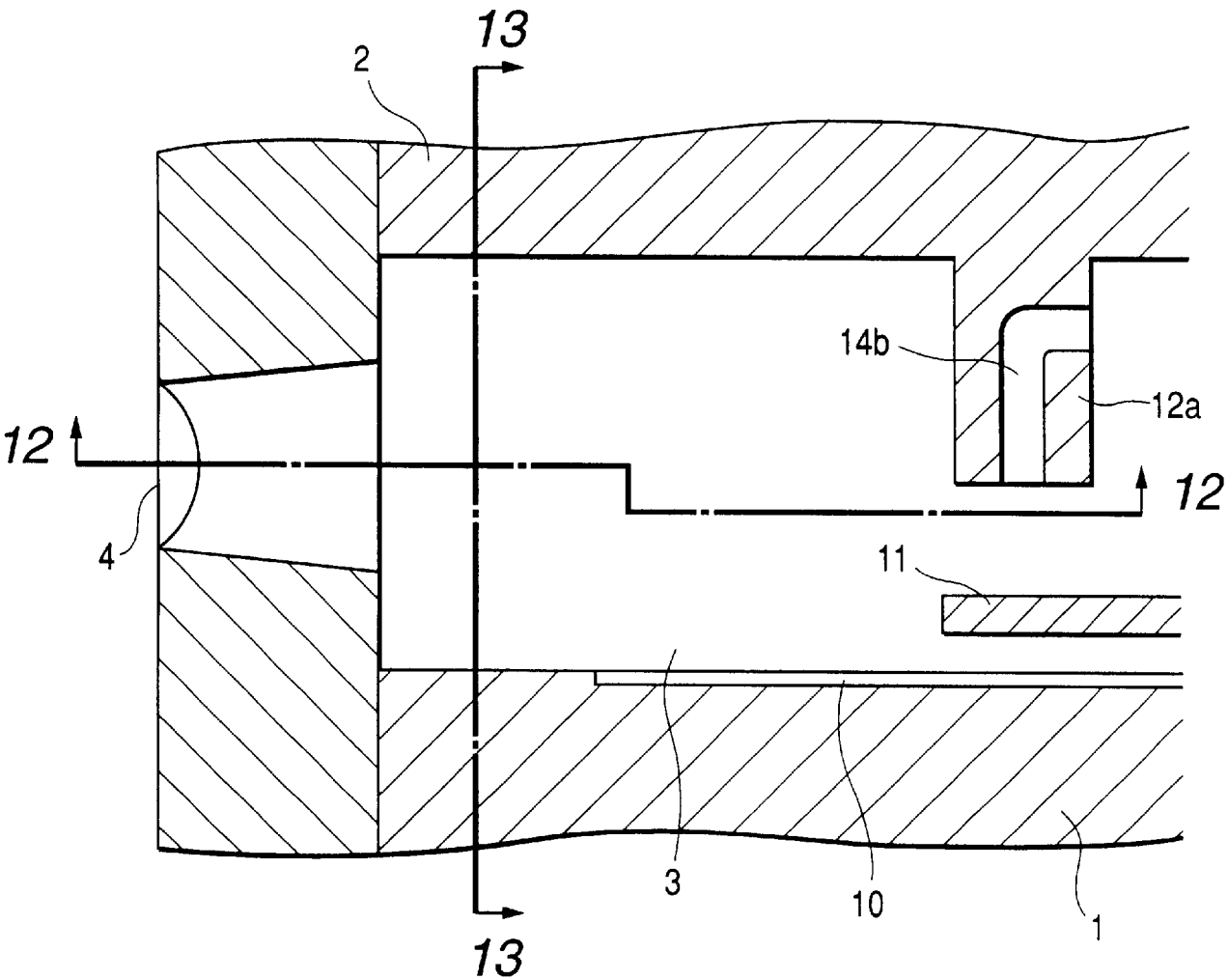
FIG. 11 is a cross-sectional view showing a variation of the liquid discharge shown in FIGS. 8 to 10.
Figure 12:
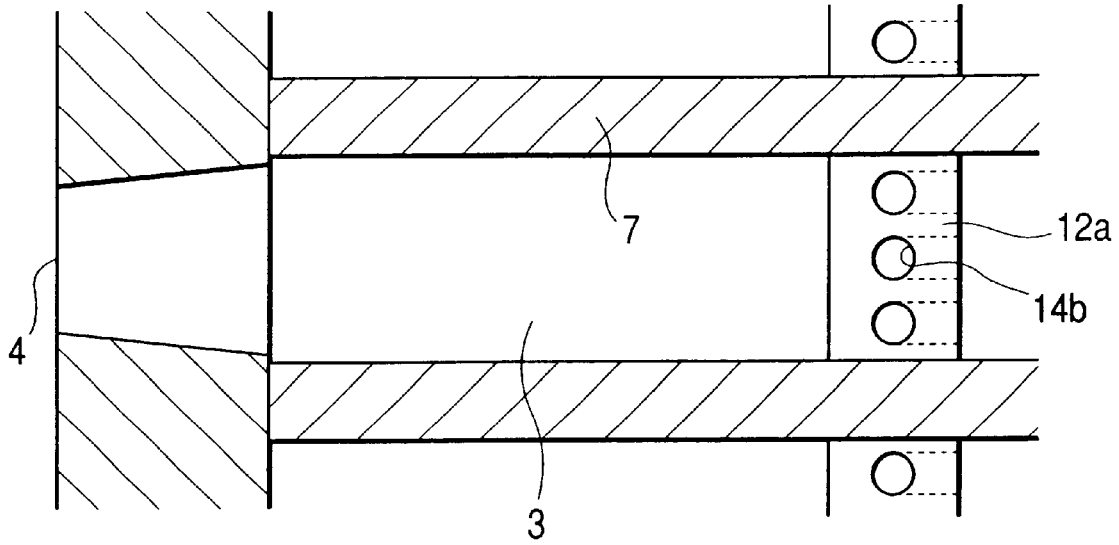
FIG. 12 is a cross-sectional view along a line 12—12 in FIG. 11.
Figure 13:
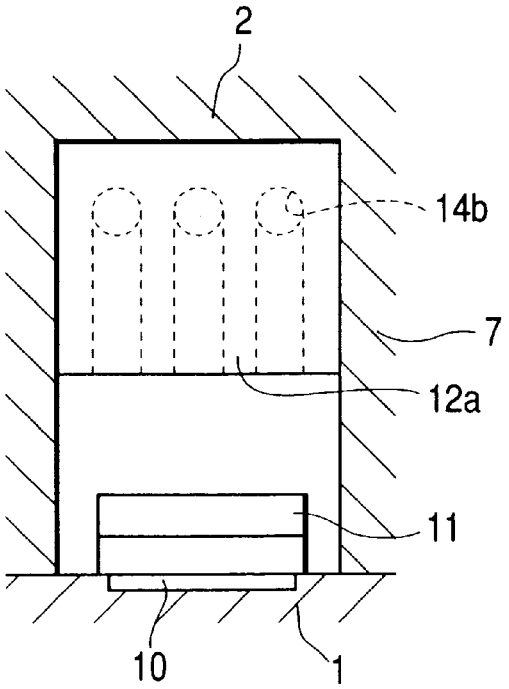
FIG. 13 is a cross-sectional view along a line 13—13 in FIG. 11.

FIG. 11 is a cross-sectional view showing a variation of the liquid discharge head shown in FIGS. 8 to 10, while FIG. 12 is a cross-sectional view along a line 12—12 in FIG. 11, and FIG. 13 is a cross-sectional view along a line 13—13 in FIG. 11. In comparison with the liquid discharge head shown in FIGS. 8 to 10, in which the liquid flow paths 14*a* formed inside the front end stopper 12*a* communicate with the downstream side of the front end stopper 12*a* in the liquid flow path 3, the liquid discharge head shown in FIGS. 11 to 13 has the liquid flow paths formed inside the front end stopper 12*a* communicate with the upstream side of the front end stopper 12*a* in the liquid flow path 3.

In the variation, shown in FIGS. 11 to 13, of the liquid discharge head shown in FIGS. 8 to 10, plural liquid flow paths 14*b* are formed inside the front end stopper 12*a*, and an end of each liquid flow path 14*b* is opened on the face of the front end stopper 12*a* opposed to the movable member 11 while the other end opens on the face of the front end stopper 12*a* at the side of the common liquid chamber 6. Consequently, in the liquid discharge head of the present embodiment, the face of the front end stopper 12*a* opposed to the movable member 11 is provided with holes constituting recesses serving as the first discharging structure and also constituting the liquid flow paths 14*b*.

In such liquid discharge head, when the movable member 11 displaces toward the front end stopper 12*a*, a part of the ink present in the area between the front end stopper 12*a* and the movable member 11 is promptly discharged, through the liquid flow paths 14*b*, from the ends thereof at the side of the common liquid chamber 6 to the upstream side of the liquid flow path 3, namely to the low pressure side. Also when the movable member 11 displaces away from the front end stopper 12*a* from a state in contact therewith or close thereto, the ink present close to the front end stopper 12*a* at the side of the common liquid chamber 6 is supplied, through the liquid flow paths 14*b* from the ends thereof at the side of the common liquid chamber 6, to the area between the front end stopper 12*a* and the movable member 11.

Therefore, in the ink discharging operation, there can be reduced the loss of the bubble generating energy from the heat generating member 10. Also, as in the liquid discharge head of the first embodiment having the grooves on the front end stopper 12*a*, there can be reduced the resistance by the liquid layer present between the front end stopper 12*a* and the movable member 11 when the movable member 11 displaces toward the front end stopper 12*a* by the bubble generation and when the movable member 11 displaces away from the front end stopper 12*a*. As a result, there can be reduced the time required by the movable member 11 for contacting the front end stopper 12*a* and the time required by the movable member 11 for returning from the front end stopper 12*a* to the initial position, whereby the deterioration in the response speed (response frequency) of the movable member 11 can be prevented.

Third Embodiment

Figure 14C:
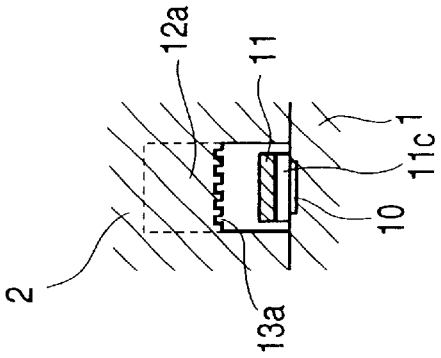
FIGS. 14A, 14B and 14C are cross-sectional views showing a liquid discharge head of a third embodiment of the present invention.
Figure 14A:
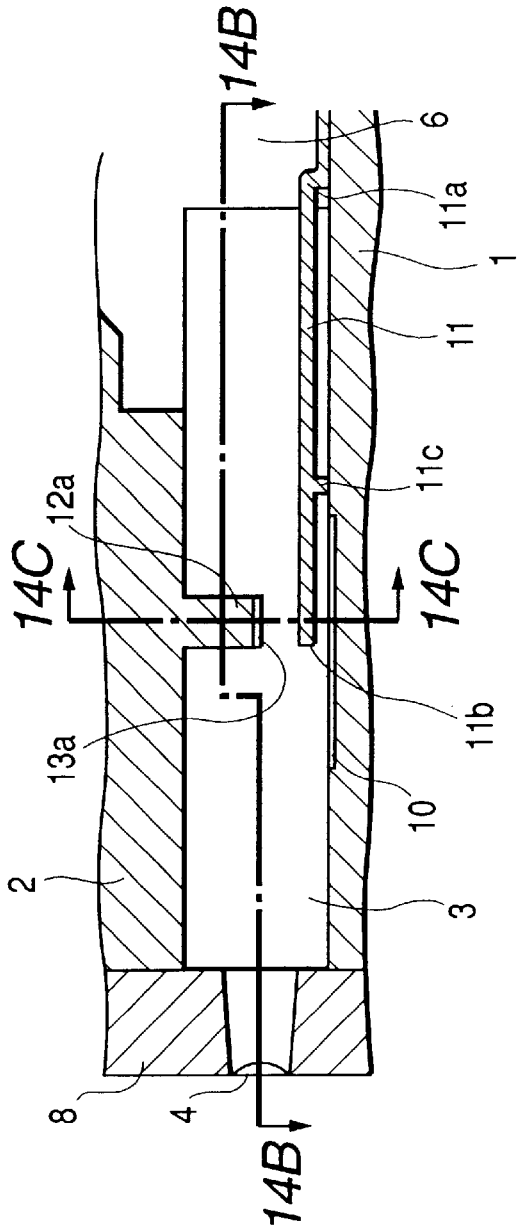
Figure 14B:
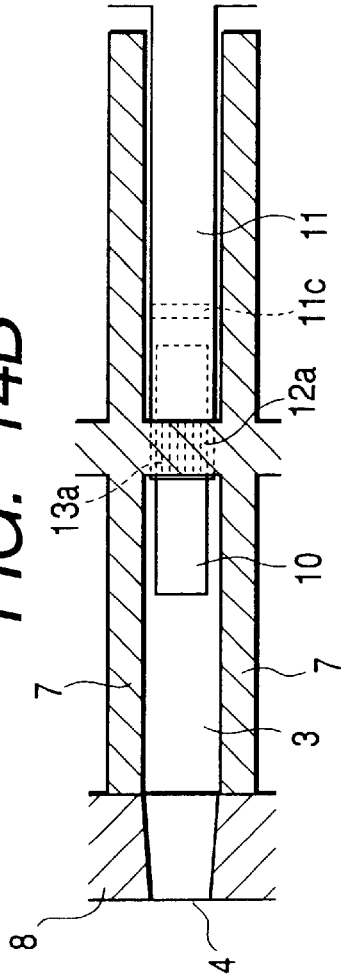

FIGS. 14A to 14C are cross-sectional view showing a liquid discharge head constituting a third embodiment of the present invention, wherein FIG. 14A is a cross-sectional view thereof along the liquid flow path, FIG. 14B is a cross-sectional view along a line 14B—14B in FIG. 14A and FIG. 14C is a cross-sectional view along a line 14C—14C in FIG. 14A.

The liquid discharge head of the present embodiment, in comparison with that of the first embodiment, is principally different in that projections are formed on a face of the front end stopper opposed to the movable member. In FIGS. 14A to 14C, components same as those in the first embodiment are represented by same numbers. In the following there are principally explained points different from the first embodiment.

The liquid discharge head of the present embodiment is provided, as shown in FIGS. 14A to 14C, on a face opposed to the element substrate 1 of the movable member, mounted on the element substrate 1, with downward projections 11c protruding toward the element substrate 1 in the vicinity of the bubble generating area. Such downward projections 11c serve to suppress the growth of the bubble, generated in the bubble generating area, toward the back (upstream) side.

FIGS. 15A1 to 16B2 are views showing the discharge operation of the liquid discharge head shown in FIGS. 14A to 14C. FIGS. 15A1, 15B1, 16A1 and 16B1 are cross-sectional views of the liquid discharge head along the liquid flow path, FIG. 15A2 is a cross-sectional view along a line 15A2—15A2 in FIG. 15A1, FIG. 15B2 is a cross-sectional view along a line 15B2—15B2 in FIG. 15B1, FIG. 16A2 is a cross-sectional view along a line 16A2—16A2 in FIG. 16A1, and FIG. 16B2 is a cross-sectional view along a line 16B2—16B2 in FIG. 16B1.

FIGS. 15A1 and 15A2 show a state where a part of the liquid in the bubble generating area on the heat generating member 10 is heated whereby a bubble 40 starts to be generated by film boiling. FIGS. 15B1 and 15B2 show a state where the movable member 11 displaces larger than in FIGS. 15A1 and 15A2 and is positioned close to the front end stopper 12*a*. FIGS. 16A1 and 16A2 show a state where the movable member 11 displaces to a position in contact with or close to the front end stopper 12*a* and is prevented from further upward displacement at the front end, while FIGS. 16B1 and 16B2 show a state where the internal negative pressure of the bubble 40 overcomes the liquid movement to the downstream side in the liquid flow path 3 after the aforementioned film boiling, whereby the bubble 40 starts to contact.

In such discharging operation, the presence of the downward projections 11c on the movable member 11 reduces, as shown in FIGS. 15A1, 15B1, 16A1 and 16B1, the grows in the back (upstream) side in comparison with the first embodiment. The downward projections 11c, serving to suppress the backward growth of the bubble 40, contributes to increase the discharge energy to be utilized for discharging the liquid droplet 66.

The downward projections 11*c* are desirably provided in a position at least separate from the stepped portion around the heat generating member 10, since they may come into contact with the element substrate 1 when the movable member 11 is displaced toward the element substrate 1. More specifically, the downward projections 11*c* are separated at least by 5 $\mu$m from the effective bubble generating area. However, they cannot exert the effect of suppressing the backward growth of the bubble if they are excessively distant from the bubble generating area, so that they are desirably provided within a range from the effective bubble generating area of the heat generating member 10 to an approximate half of the length of the heat generating member. More specifically, in the present embodiment, the distance from the effective bubble generating area to the downward projections 11*c* is about 45 $\mu$m, preferably not exceeding 30 $\mu$m and more preferably not exceeding 20 $\mu$m.

Also the height of the downward projections 11*c* is approximately equal to or less than the distance between the movable member 11 and the element substrate 1, whereby, in the present embodiment, there is formed a slight clearance between the ends of the downward projections 11*c* and the element substrate 1.

Such downward projections 11*c* suppresses the extension of the bubble, generated in the bubble generating area, toward the upstream side through the gap between the movable member 11 and the element substrate 1, whereby the liquid movement to the upstream side is further reduced than in the first embodiment and the refilling characteristics can be further improved.

Fourth Embodiment

Figure 17A:
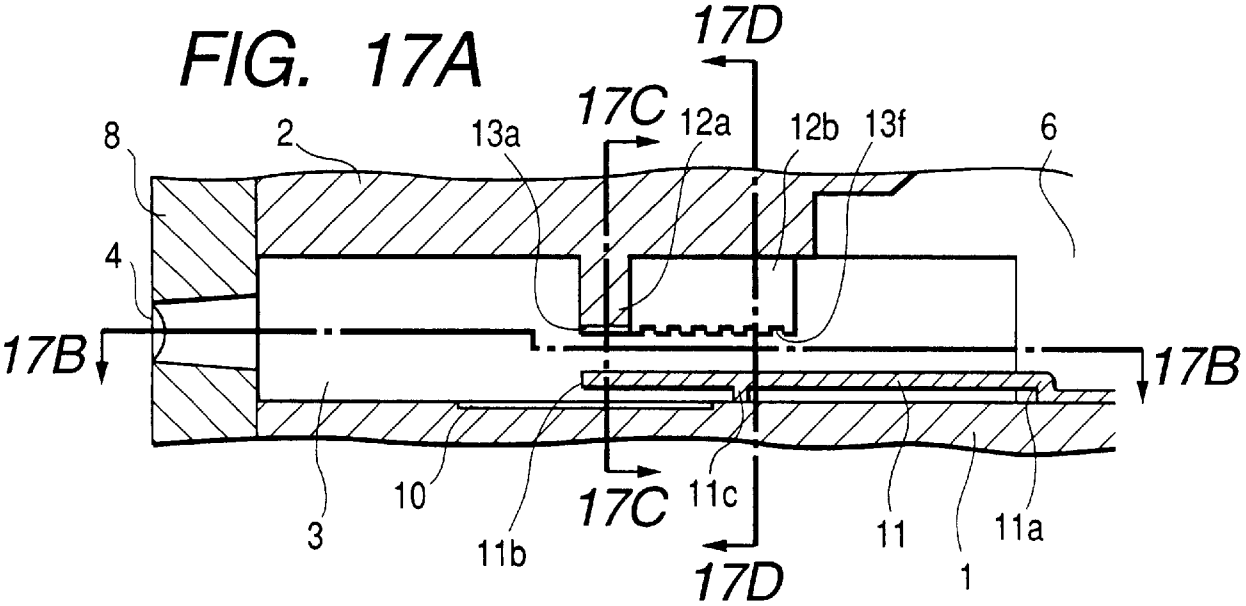
FIGS. 17A, 17B, 17C and 17D are cross-sectional views showing a liquid discharge head of a fourth embodiment of the present invention.
Figure 17C:
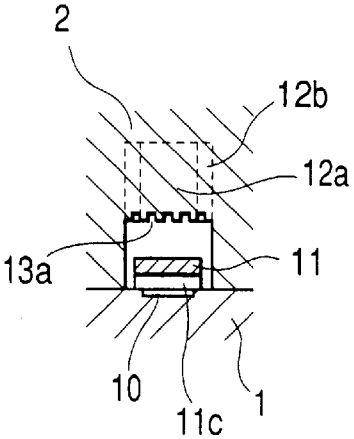
Figure 17B:
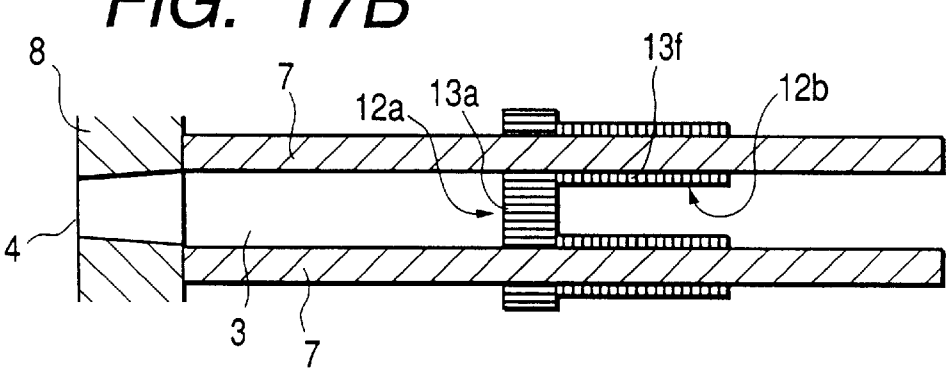
Figure 17D:
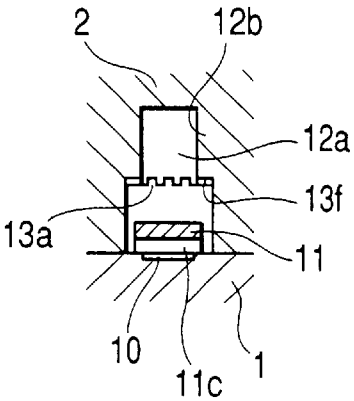

FIGS. 17A to 17D are cross-sectional view showing a liquid discharge head constituting a fourth embodiment of the present invention, wherein FIG. 17A is a cross-sectional view thereof along the liquid flow path, FIG. 17B is a cross-sectional view along a line 17B—17B in FIG. 17A, FIG. 17C is a cross-sectional view along a line 17C—17C in FIG. 17A, and FIG. 17D is a cross-sectional view along a line 17D—17D in FIG. 17A.

The liquid discharge head of the present embodiment, in comparison with that of the second embodiment, is principally different in that a side stopper coming into substantial contact with a side portion of the movable member displaced by the bubble growth. In FIGS. 17A to 17D, components same as those in the second embodiment are represented by same numbers. In the following there will be principally explained points different from the first and second embodiments.

The liquid discharge head of the present embodiment is provided, as shown in FIGS. 17A to 17D, in addition to the front end stopper 12*a*, with a side stopper 12*b* constituting a side limiting portion on each upper side of the movable member 11. On a face of each side stopper 12*b*, opposed to the movable member 11, there are formed plural grooves 13*f* extending in a direction perpendicular to the direction of the liquid flow path 3 as a discharge path for facilitating the liquid layer discharge. Such plural grooves 13*f* on the side stopper 12*b* forms a projection between the two adjacent grooves 13*f*, whereby irregularities are formed as a second exhaustion accelerating structure on the surface of the side stopper 12*b* opposed to the movable member 11.

In limiting the displacement of the movable member 11 toward the front end stopper 12*a* and the side stoppers 12*b*, namely when the movable member 11 comes into contact therewith, such side stoppers 12*b* closes the clearance between the movable member 11 and the flow path walls. Also because of the presence of the plural grooves 13*f* in the side stoppers 12*b*, when the movable member 11 is displaced by the bubble generated in the ink on the heat generating member 11 and approaches the grooves 13*f* of the side stoppers 12*b*, the ink present in the area between the side stoppers 12*b* and the movable member 11 is promptly exhausted to the exterior of such area. Also when the movable member 11 displaces away from the side stopper 12*b* from a state in contact therewith or close thereto, the ink is supplied through the grooves 13*f* to the area between the side stopper 12*b* and the movable member 11. Therefore, there can be reduced the resistance by the liquid layer present between the side stopper 12*b* and the movable member 11 when the movable member 11 displaces toward the side stopper 12*b* and when the movable member 11 displaces away from the side stopper 12*b*.

Thus, there can be reduced the time required by the movable member 11 for contacting the front end stopper 12*a* and the side stoppers 12*b*, and the time required by the movable member 11 for leaving the front end stopper 12*a* and the side stoppers 12*b* and returning to the initial position. As a result, there can be prevented the liquid movement to the upstream side in the liquid flow path 3 when the movable member 11 approaches the front end stopper 12*a* and the side stoppers 12*b* and the deterioration in the response speed (response frequency) of the movable member 11.

The above-described configuration allows to attain more securely the separation of the functions of the upstream and downstream sides in relation to the form characteristics of the bubble, by means of mechanical factors. In the conventional configuration, the balance of the flow path resistance in the upstream and downstream portions of the liquid flow path has been the most critical factor, but the above-described configuration allows to significantly increase the freedom of designing by separating the functions.

In the foregoing description, the side stopper 12*b* is provided on the top plate 2, but such configuration is not restrictive and the side stopper 12*b* may be provided only on the side wall 7.

FIGS. 18A1 to 19B2 are views showing the discharge operation of the liquid discharge head shown in FIGS. 17A to 17D. FIGS. 18A1, 18B1, 19A1 and 19B1 are cross-sectional views of the liquid discharge head along the liquid flow path, FIG. 18A2 is a cross-sectional view along a line 18A2—18A2 in FIG. 18A1, FIG. 18B2 is a cross-sectional view along a line 18B2—18B2 in FIG. 18B1, FIG. 19A2 is a cross-sectional view along a line 19A2—19A2 in FIG. 19A1, and FIG. 19B2 is a cross-sectional view along a line 19B2—19B2 in FIG. 19B1.

FIGS. 18A1 and 18B2 show a state where a part of the liquid in the bubble generating area on the heat generating member 10 is heated whereby a bubble 40 starts to be generated by film boiling. In the state shown in FIGS. 18A1 and 18A2, the clearance between the side stopper 12*b* and the movable member 11 is still large but decreases with the displacement thereof.

FIGS. 18B1 and 18B2 show a state where the movable member 11 displaces larger than in FIGS. 18A1 and 18A2 and is positioned close to the front end stopper 12*a*. In this state, since the clearance between the front end stopper 12*a*, side stoppers 12*b* and the movable member 11 is small, the passing of the liquid from the bubble generating area to the upstream side, namely toward the common liquid chamber 6, is considerably restricted than in the first and second embodiments. As a result, there is generated a large pressure difference, at the movable member 11, between the bubble generating area and the common liquid chamber 6 whereby the movable member 11 is pressed closely to the side stoppers 12*b*. Consequently the contact of the movable member 11 with the front end stopper 12*a* and the side stoppers 12*b* is increased, and the liquid leakage through the clearance between the movable member 11 and the flow path wall is reduced even if there is provided a sufficiently large clearance. Such configuration increases the separation of the bubble generating area from the common liquid chamber 6, thereby reducing the loss of the discharging power resulting from the leakage of liquid toward the common liquid chamber 6.

A part of the ink present in the area between the front end stopper 12*a* and the movable member 11 is exhausted from such area through the grooves 13*a* formed on the front end stopper 12*a* and constituting an exhaustion path to the upstream and downstream sides of the liquid flow path 3, namely to the exterior of the above-mentioned area. At the same time, a part of the ink present in the area between the side stopper 12*b* and the movable member 11 is exhausted from such area through the discharge grooves 13*f* formed on the side stopper 12*b* to the exterior of the such area. Thus, at the displacement of the movable member 11 toward the front end stopper 12*a* and the side stoppers 12*b*, there is reduced the resistance to the movable member 11 by the liquid layer present between the front end stopper 12*a* and the movable member 11 and the liquid layer present between the side stopper 12*b* and the movable member 11, whereby movable member 11 displaces rapidly. Thus, in comparison with a case without the grooves 13*a* and 13*f*, there is shortened the time required by the movable member 11 to contact the front end stopper 12*a* and the side stoppers 12*b* whereby the ink movement to the upstream side in this state in the liquid flow path 3 is suppressed and the loss of the bubble generating energy from the heat generating member 10 is reduced.

FIGS. 19A1 and 19A2 show a state where the movable member 11 displaces to a position in contact with or close to the front end stopper 12*a* and the side stoppers 12*b* and is prevented from further upward displacement at the front end by the front end stopper 12*a* and the side stoppers 12*b*.

On the other hand, as the displacement of the movable member 11 is limited by the front end stopper 12*a* and the side stoppers 12*b* as explained in the foregoing, the upstream portion of the bubble 40 remains at a small size, in a state of bending the movable member 11 toward the upstream side by the inertial force of the liquid flow toward the upstream side and charging the stress in the movable member 11. In the entire configuration in this part, the front end stopper 12*a*, side stoppers 12*b*, side walls 7, movable member 11 and fulcrum 11*a* thereof reduce the liquid amount entering the upstream side to almost zero, thereby preventing the fluid crosstalk to the adjacent liquid flow paths and the reverse liquid flow or the pressure vibration in the liquid supply system inhibiting the high speed refilling. FIGS. 19B1 and 19B2 show a state where the internal negative pressure of the bubble 40 overcomes the liquid movement to the downstream side in the liquid flow path 3 after the aforementioned film boiling, whereby the bubble 40 starts to contact. In this state the liquid flow into the liquid flow path 3 through the gap between the front end stopper 12*a* or the side stoppers 12*b* and the movable member 11 to acts, as shown in FIGS. 19A1 and 19A2, as to increase the flow speed in the flow path 3 at the side of the top plate 2, thereby extremely reducing the remnant microbubbles in such area and stabilizing the liquid discharge.

Also the damage to the heat generating member 10 can be reduced since the point of cavitation by the bubble vanishing is displaced toward the downstream side of the bubble generating area. At the same time, the kogation on the heat generating member (heater) 10 by the cavitation phenomenon in such area is reduced to improve the discharge stability.

If the gap between the front end stopper 12*a* or the side stopper 12*b* and the movable member 11 is small in the downward displacement thereof away from the front end stopper 12*a* and the side stoppers 12*b*, the ink present in the vicinity of the grooves 13*a* of the front end stopper 12*a* is supplied through such grooves 13*a* to the area between the front end stopper 12*a* and the movable member 11. Also the ink present in the vicinity of the grooves 13*f* of the side stopper 12*b* is supplied through such grooves 13*f* to the area between the side stopper 12*b* and the movable member 11. Therefore, when the movable member 11 leaves a state where it is in contact with or close to the front end stopper 12*a* and the side stoppers 12*b* and returns to the initial position, the resistance to the movable member 11 is suppressed whereby it can rapidly displace. Thus, in comparison with a case of absence of the grooves 13*a* and 13*f*, there is shortened the time required by the movable member 11 to leave the front end stopper 12*a* and to return to the initial position.

As explained in the foregoing, in the liquid discharge head of the present embodiment, in comparison with a case without the grooves 13*a* and 13*f*, there are shortened the time required by the movable member 11 to contact the front end stopper 12*a* and the side stoppers 12*b* and the time required by the movable member 11 to leave the front end stopper 12*a* and the side stoppers 12*b* and to return to the initial position, whereby prevented is the loss of the response speed (response frequency) of the movable member 11, resulting from the presence of the front end stopper 12*a* and the side stoppers 12*b* in the liquid flow path 3.

The liquid discharge head of the present embodiment is provided, on the face of the side stopper 12*b* opposed to the movable member 11, with the grooves 13*f* extending perpendicularly to the direction of the liquid flow path 3, but such grooves 13*f* may be replaced by plural grooves extending along the direction of the liquid flow path 3. Also such grooves 13*f* may be arranged in zigzag manner that the two adjacent grooves 13*f* have mutually different longitudinal positions, as in the pattern of the grooves 13*b*, 13*c* shown in FIG. 5 in the first embodiment. Also as irregularities on the face of the side stopper 12*b* opposed to the movable member 11, there may be formed grooves and island-shaped projections similar to those 13*e*, 15 as shown in FIG. 7. Further, the side stopper 12*b* may be provided with liquid paths, serving as exhaustion paths, similar to those 14*a*, 14*b* inside the front end stopper 12*a* of the liquid discharge head of the second embodiment.

Fifth Embodiment

Figure 20:
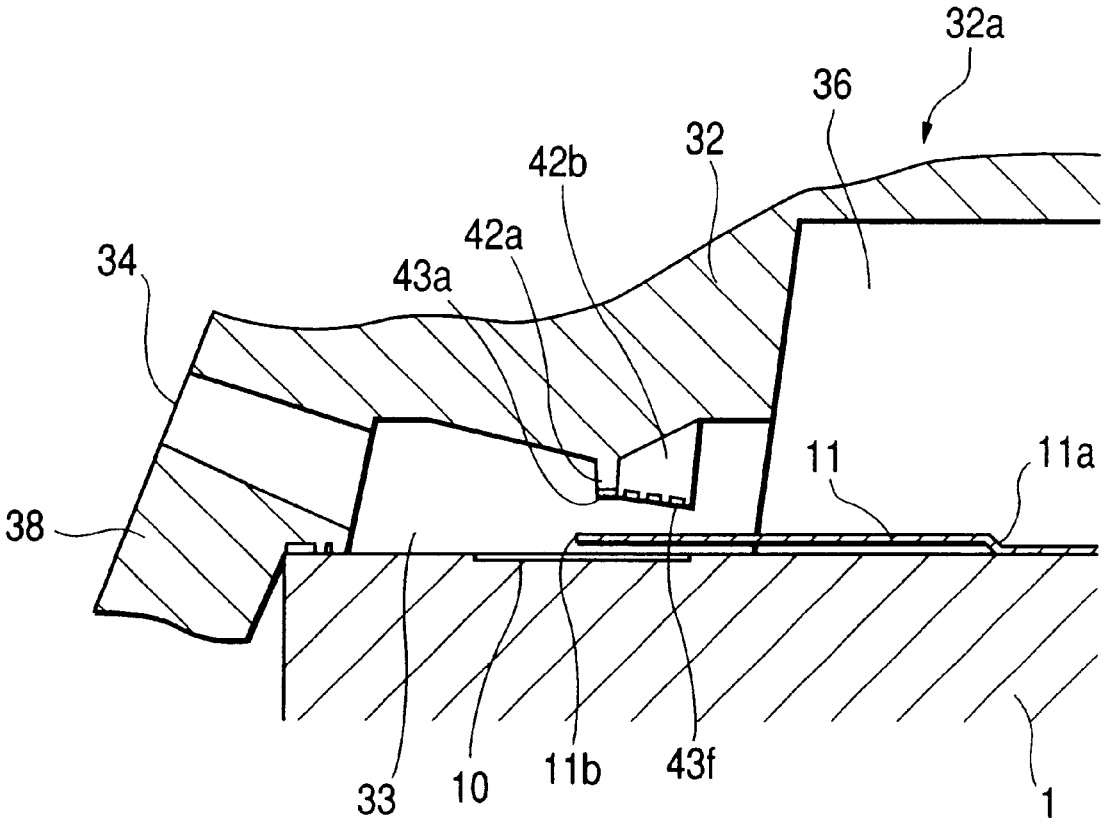
FIG. 20 is a cross-sectional view, along the liquid flow path, showing a liquid discharge head of a fifth embodiment of the present invention.

FIG. 20 is a cross-sectional view showing a liquid discharge head constituting a fifth embodiment of the present invention, along the liquid flow path. The liquid discharge head of the present embodiment employs a grooved top plate integrally containing a top plate portion with grooves for forming the common liquid chamber and the liquid flow paths, and an orifice plate portion in which the discharge ports are to be formed.

As shown in FIG. 20, the liquid discharge head of the present embodiment employs the element substrate 1 same as in the first embodiment, which is provided as in the first embodiment with the movable member 11 at the surface bearing the heat generating member 10. To such surface of the element substrate 1, there is adjoined a grooved top plate 32*a* composed of a top plate portion 32 and an orifice plate portion 38. The top plate portion 32 includes plural grooves for forming liquid flow paths 33 containing the heat generating members 10 and a groove for forming a common liquid chamber 36 communicating with the liquid flow paths 33. The orifice plate 38 is provided with discharge ports 34 communicating with the liquid flow paths 33, wherein the discharge port 34 extends obliquely to the element substrate 1 as it is formed by laser irradiation of the orifice plate portion 38 from the side of the liquid flow path 33.

In the liquid flow path 33, above the free end 11*b* of the movable member 11, namely opposite to the heat generating member 10, there is provided a front end stopper 4*a* constituting a limiting portion for limiting the upward displacement of the movable member 11, and on a surface of the front end stopper 12*a* at the side of the movable member 11, there are formed plural grooves 43*a* extending along the direction of the liquid flow path 33. Also at the upstream side of the front end stopper 42*a* and above the movable member 11, there are provided side stoppers 42*b* for substantially contacting the side portions of the movable member 11 displaced by the bubble growth, and on a surface of the side stoppers 42*b*, there are formed plural grooves 43*f* extending perpendicularly to the direction of the liquid flow path 33.

Also in such liquid discharge head, by the presence of the plural grooves 43*a* on the front end stopper 42*a* and the plural grooves 43*f* on the side stoppers 42*b*, there can be reduced the time required by the movable member 11 for contacting the front end stopper 42*a* and the side stoppers 42*b* and the time required by the movable member 11 for leaving the front end stopper 42*a* and the side stoppers 42*b* and returning to the initial position, whereby the deterioration in the response speed (response frequency) of the movable member 11 can be prevented. Also the shortened time required by the movable member 11 for contacting the front end stopper 42*a* and the side stoppers 42*b* suppresses the ink movement to the upstream side in the liquid flow path 33, thereby reducing the loss of the bubble generating energy from the heat generating member 10 and suppressing the vibration of the meniscus, to realize stable recording quality from a low driving frequency to a high driving frequency.

Sixth Embodiment

Figure 21:
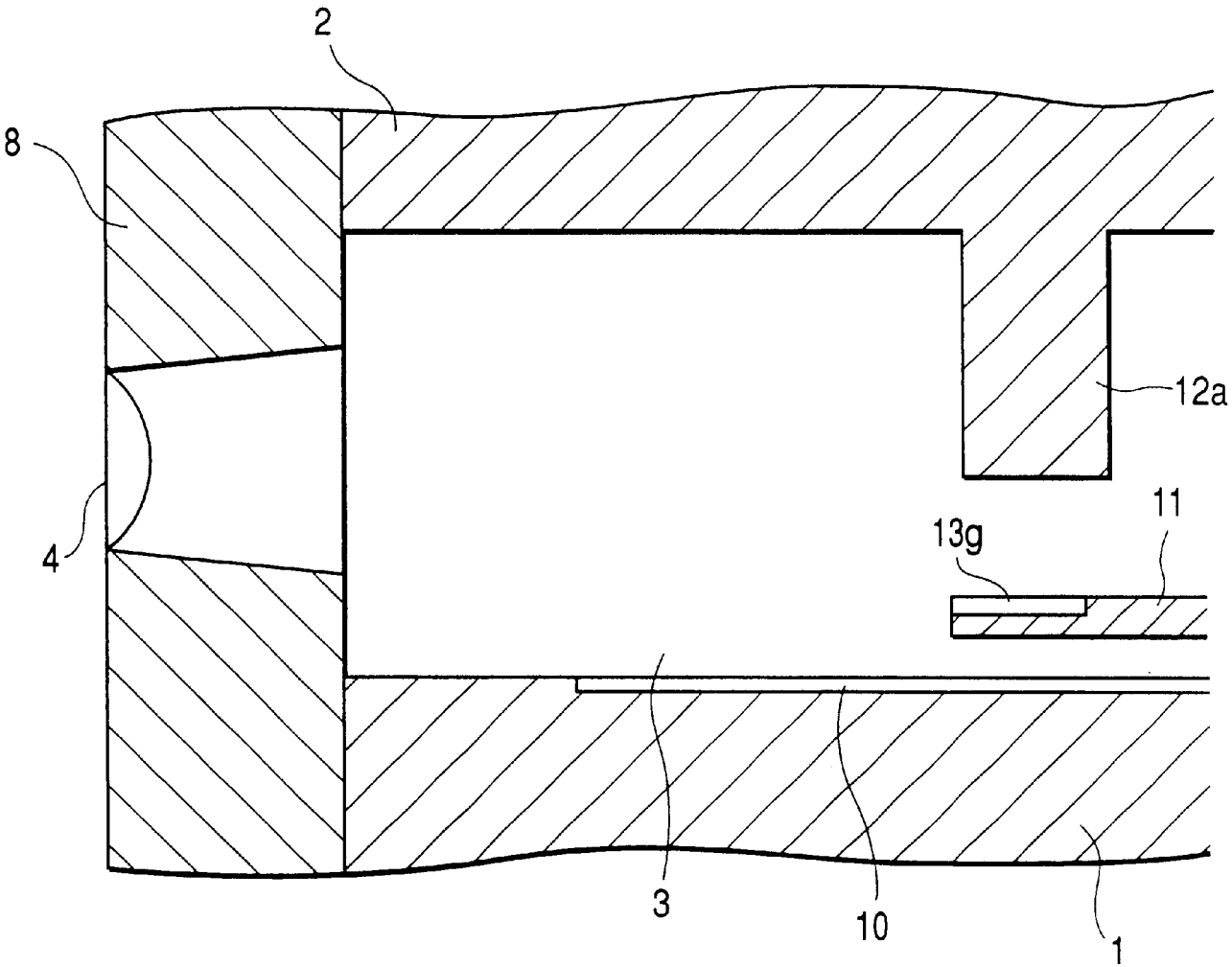
FIG. 21 is a cross-sectional view, along the liquid flow path, showing a liquid discharge head of a sixth embodiment of the present invention.

FIG. 21 is a cross-sectional view showing a liquid discharge head constituting a sixth embodiment of the present invention, along the liquid flow path. The liquid discharge head of the present embodiment is different, from that of the first embodiment, in that the grooves are not formed in the front end stopper for limiting the displacement of the movable member but on a surface thereof coming into substantial contact with the front end stopper. In FIG. 20, components same as those in the first embodiment are represented by same numbers, and, in the following, there will be principally explained the points different from the first embodiment.

As shown in FIG. 21, the liquid discharge head of the present embodiment is provided with plural grooves 13g extending along the direction of the liquid flow path 3, on a face of the movable member coming into substantial contact with the front end stopper 12*a*, namely a surface of the movable member 11 at the end closest to the discharge port 4 and opposed to the front end stopper 12*a*.

Figure 22A:
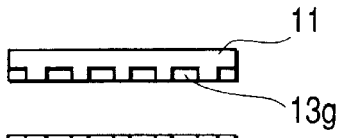
FIGS. 22A and 22B are respectively a lateral view and a plan view of a front end portion of a movable member shown in FIG. 21.
Figure 22B:
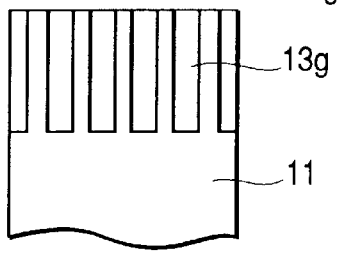

FIGS. 22A and 22B are respectively a lateral view and a plan view of the front end portion of the movable member 11 shown in FIG. 21, wherein FIG. 22A is a lateral view of the movable member 11 seen from the side of the front end face thereof while FIG. 22B is a plan view of the front end portion of the movable member 11. As shown in FIGS. 22A and 22B, the plural grooves 13*f* formed on the front end portion of the movable member 11 are formed parallel to the direction of the liquid flow path 3 and are arranged perpendicularly thereto, and each groove 13*f* extends from the front end face of the movable member 11 to a predetermined position thereof. Such plural grooves 13*f* forms a projection between the two adjacent grooves 13*f*, whereby irregularities are formed as the first exhaustion accelerating structure on the front end surface of the movable member 11 at the side of the discharge port 4 and opposed to the front end stopper 12*a*.

The presence of the plural grooves 13*f* in the movable member 11 allows, when the movable member 11 is displaced by the bubble generated in the ink on the heat generating member 10 and approaches the front end stopper 12*a* having the grooves 13*a*, the ink present in the area between the front end stopper 12*a* and the movable member 11 to be promptly exhausted to the exterior of such area. Also in case the movable member 11 is displaced in a direction away from the front end stopper 12*a*, from a state where the movable member 11 is in contact with or close to the front end stopper 12*a*, the ink is supplied through the grooves 13*f* to the area between the front end stopper 12*a* and the movable member 11. Thus, when the movable member 11 approaches the front end stopper 12*a* or moves away therefrom, there is reduced the resistance to the movable member 11 by the liquid layer present between the front end stopper 12*a* and the movable member 11. Consequently there are shortened the time required by the movable member 11 to contact the front end stopper 12*a* and the time required by the movable member 11 to be separated from the front end stopper 12*a* and to return to the initial position.

As a result, when the movable member 11 approaches the front end stopper 12*a*, the movement of the liquid to the upstream side in the liquid flow path can be suppressed, and the loss in the response speed (response frequency) of the movable member 11 can be prevented. Also in the ink discharging operation from the discharge port 4, there is suppressed the liquid movement toward the upstream side in the liquid flow path 3 to suppress the vibration of the meniscus and to provide stable recording quality from a low driving frequency to a high driving frequency. In such ink discharging operation, there is also reduced the loss of the bubble generating energy from the heat generating member 10. Also there can be provided a liquid discharge head capable of high speed recording, since the response frequency of the movable member 11 can be elevated to increase the driving frequency of the liquid discharge head.

Figure 23A:
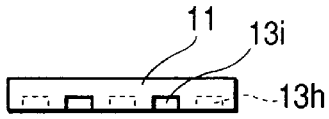
FIGS. 23A and 23B are respectively a lateral view and a plan view of a variation of the movable member shown in FIGS. 21, 22A and 22B.
Figure 23B:
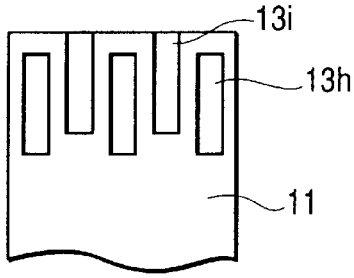
Figure 24A:
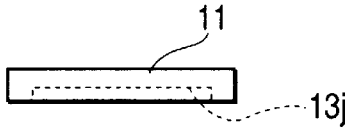
FIGS. 24A and 24B are respectively a lateral view and a plan view of a variation of the movable member shown in FIGS. 21, 22A and 22B.
Figure 24B:
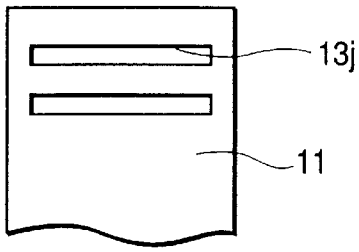
Figure 25A:
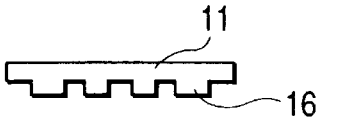
FIGS. 25A and 25B are respectively a lateral view and a plan view of a variation of the movable member shown in FIGS. 21, 22A and 22B.
Figure 25B:
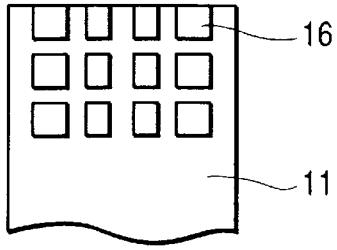

FIGS. 23A to 25B are lateral views and plan views showing variations of the movable members 11 shown in FIGS. 21 to 22B, wherein FIGS. 23A, 24A and 25A are lateral views of the movable member 11 seen from the front end face side thereof while FIGS. 23B, 24B and 25B are plan views of the front end portion of the movable member 11.

In a variation of the movable member 11 shown in FIGS. 23A and 23B, there are provided, on a surface of the movable member 11 at an end close to the discharge port 3, a groove 13*h* extending along the direction of the liquid flow path from a position separated from the end face of the movable member 11 to a predetermined position at the side of the common liquid chamber 6, and a groove 13*i* extending along the direction of the liquid flow path from the end face of the movable member 11 to an end position same as that of the groove 13*h*, each in plural units. The grooves 13*h*, 13*i* are alternately arranged in a direction perpendicular to the direction of the liquid flow path 3. Consequently, in the movable member 11, the grooves 13*h*, 13*i* are alternately arranged in such a manner that the two adjacent grooves 13*h*, 13*i* are different in the longitudinal position.

In a variation of the movable member 11 shown in FIGS. 24A and 24B, there are formed plural grooves 13*i* extending perpendicularly to the direction of the liquid flow path 3 on the surface of the movable member 11 at an end thereof close to the discharge port 4 and opposed to the front end stopper 12*a*.

In a variation of the movable member 11 shown in FIGS. 25A and 25B, there are formed plural island-shaped projections 16, arranged in a matrix, on a surface of the movable member 11 at the end thereof close to the discharge port 4 and opposed to the front end stopper 112*a*. Such projections 15 are constituted by forming grid-shaped grooves on such surface of the movable member 11. Thus, such formation of the plural island-shaped projections 16 provides irregularities on the surface of the movable member 11 at an end thereof close to the discharge port 4 and opposed to the front end stopper 12*a*.

Also the movable member 11 may be provided, instead of the grooves or projections, with a liquid flow path serving as an exhaustion path, similar to the liquid flow paths 14*a*, 14*b* formed inside the front stopper 12*a* of the liquid discharge head in the second embodiment. In such case, an end of the liquid flow path formed on the movable member 11 may be opened in a position corresponding to the front end stopper 12*a*, on a surface of the movable member 11 opposed to the front end stopper 12*a*, and the other end may be opened in a position close to the fulcrum 11*a* of the movable member 11 on the element substrate 1, on a front end surface of the movable member 11 close to the discharge port 4, or in a position upstream of the front end stopper 12*a* on a surface of the movable member 11 opposed to the front end stopper 12*a*.

Also in case the side stoppers 12*b* are provided as in the liquid discharge head of the fourth embodiment, instead of forming the grooves 13*f* in the side stoppers 12*b*, there may be formed grooves or liquid flow paths serving as discharge paths, in the side portions of the movable member 11 coming into contact with the side stoppers 12*b*. Otherwise, grooves or liquid flow paths for discharging the ink present in the area between the side stopper 12*b* and the movable member 11 may be formed on both of the side stopper 12*b* and the movable member 11.

Other Embodiments

<Side Shooter Type>

Figure 26A:
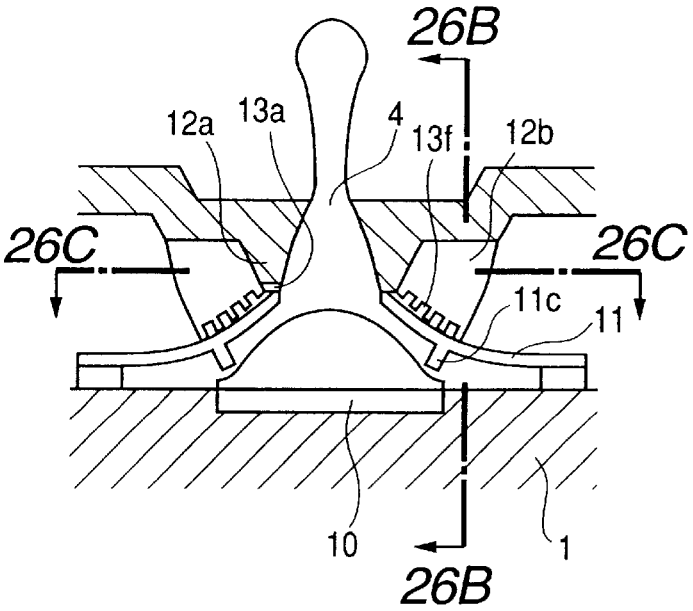
FIGS. 26A, 26B and 26C are views showing a liquid discharge head of the present invention and a liquid discharge head of side shorter type in which the liquid discharge principle of the present invention is applied.
Figure 26B:
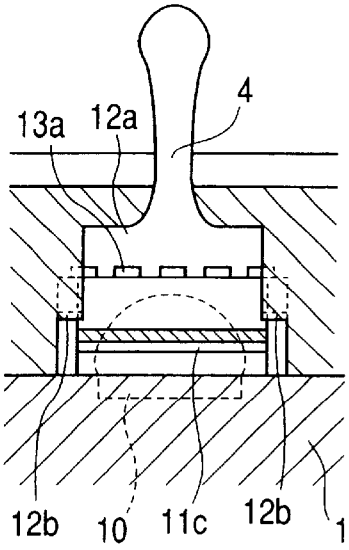
Figure 26C:
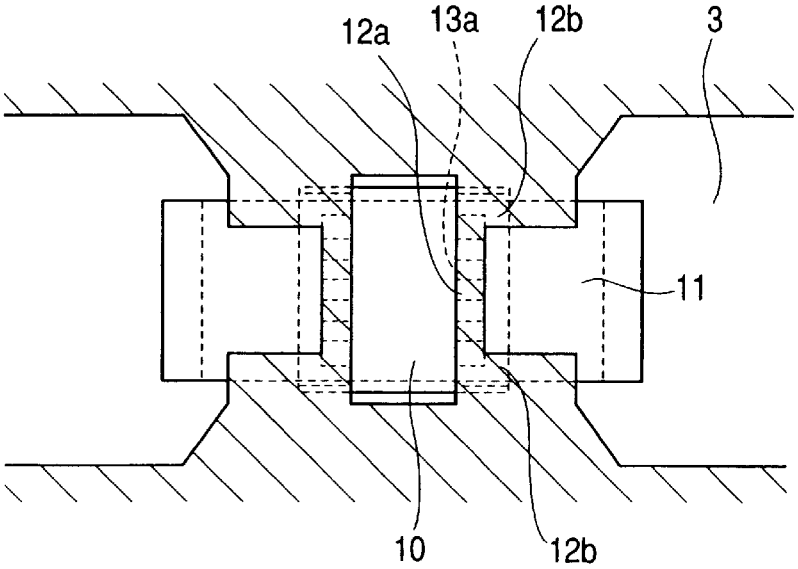

In the following there will be explained, with reference to FIGS. 26A to 28B, an application of the liquid discharge head of the present invention and the liquid discharging principle thereof to the liquid discharge head of side shooter type in which the heat generating member and the discharge port are arranged on mutually parallel two planes and are mutually opposed. FIGS. 26A to 26C are cross-sectional views showing a liquid discharge head of such side shooter type, wherein FIG. 26A is a cross-sectional along the liquid flow path of the head, FIG. 26B is a cross-sectional view along a line 26B—26B in FIG. 26A and FIG. 26C is a cross-sectional view along a line 26C—26C in FIG. 26A.

Referring to FIGS. 26A to 26C, a heat generating member 10 on an element substrate 1 is opposed to a discharge port 4 formed on a top plate 2. The discharge port 4 communicates with a liquid flow path 3 passing on the heat generating member 10. A bubble generating area is present in the vicinity of a plane where the heat generating member 10 contacts the liquid. On the element substrate 1, there are supported two movable members 11, which are positioned in plane symmetry with respect to a plane passing the center of the heat generating member 10, and the free ends of the movable members 11 are mutually opposed on the heat generating member 10. The movable members 11 have a same projected area on the heat generating member 10, and the free ends of the movable members 11 are separated by a desired distance. Assuming that the heat generating member 10 is divided by a partition wall passing through the center of the heat generating member 10, each movable member 11 is so positioned that the free end thereof is positioned close to the center of each divided heat generating member 10.

The top plate 2 is provided with a front end stopper 12*a* and side stoppers 12*b* for limiting the displacement of the movable members 11 in a certain range. In the flow in each liquid flow path 3 from the common liquid chamber 6 to the discharge port 4, there is formed a low flow path resistance area having a lower flow path resistance in comparison with that in the liquid flow path 3, at the upstream side of the front end stopper 12*a*. In such area, the flow path has a larger cross section than in the liquid flow path 3, whereby the resistance to the liquid movement from the flow path is lowered. On a surface of the front end stopper 12*a* opposed to the movable member 11, there are formed plural grooves 13*a* extending substantially parallel to the liquid flow path 3, and plural grooves 13*f* extending substantially perpendicular to the liquid flow path 3 on a surface of the side stoppers 12*b* opposed to the movable member 11.

Figure 27A:
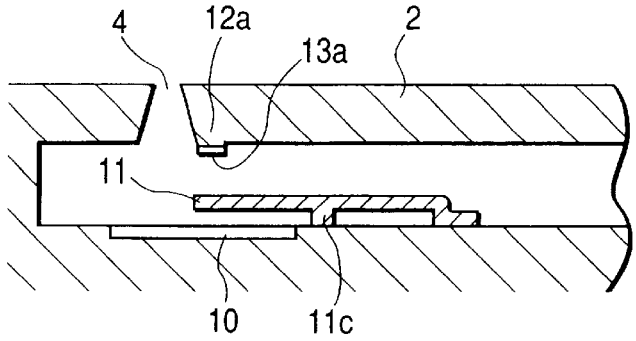
FIGS. 27A, 27B, 28A and 28B are views showing a liquid discharge head of side shooter type of a configuration having a movable member for a heat generating member.
Figure 27B:
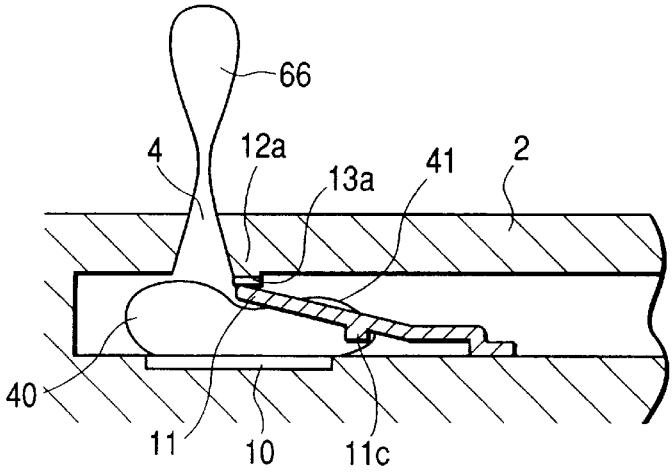
Figure 28A:
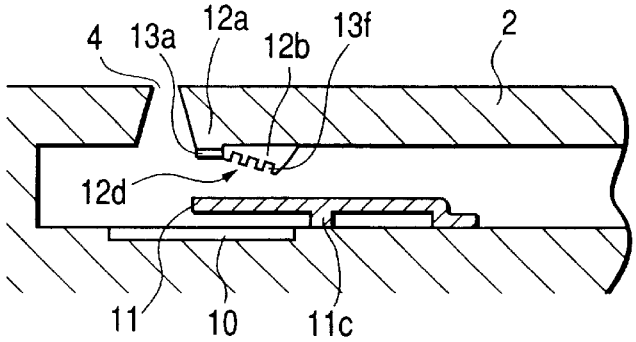
Figure 28B:
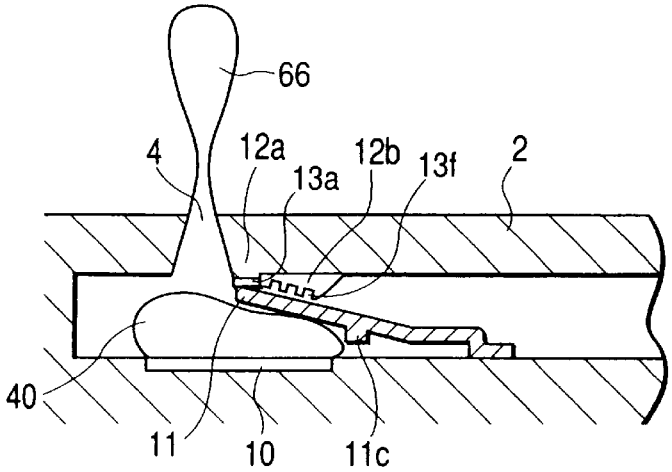

The presence of such grooves 13*a*, 13*f* enables rapid displacement of the movable member 11 in the same manner as explained in the foregoing, whereby the ink movement to the upstream side in the liquid flow path 3 is suppressed in the discharging operation and the loss in the response speed of the movable member 11 is prevented. FIGS. 27A to 28B are views showing a liquid discharge type of side shooter type, having a movable member for a heat generating member. FIGS. 27A and 27B show a liquid discharge head in which the top plate is provided with the front end stopper for limiting the displacement of the movable member within a certain range, while FIGS. 28A and 28B show a liquid discharge head in which the top plate is provided with side stoppers in addition to the front end stopper. FIGS. 27A and 28A are cross-sectional views of the liquid discharge head along the liquid flow path. FIG. 27B is a cross-sectional view showing a state of the liquid discharge head shown in FIG. 27A, in which a part of the liquid in the bubble generating area is heated by the heat generating member whereby the bubble resulting from the film boiling has reached a maximum grown state, while FIG. 28B is a cross-sectional view showing a state of the liquid discharge head shown in FIG. 28A, in which a part of the liquid in the bubble generating area is heated by the heat generating member whereby the bubble resulting from the film boiling has reached a maximum grown state.

In the liquid discharge head shown in FIGS. 28A and 28B, in order to increase the effect of suppressing the inertial force of the liquid toward the upstream side of the liquid flow path, the contact faces with the movable member 11 of the side stoppers 12*b* provided in the liquid flow path 3 are formed as inclined faces 12*d*, so inclined as to be separated from the element substrate 1 toward the downstream side of the liquid flow path 3. Such inclined portions 12*d* improve the contact state of the movable member 11 with the front end stopper 12*a* and the side stoppers 12*b* when the movable member 11 is elevated, thereby further decreasing the ink flow toward the upstream side at the bubble generation and increasing the suppression of the meniscus vibration.

In the following there will be explained, with reference to FIGS. 27B and 28B, the characteristic effects of the structures of the liquid discharge heads shown in FIGS. 27A and 28A.

In the state shown in FIG. 27A or 28A, a part of the liquid in the bubble generating area on the heat generating member 10 is heated thereby, whereby the bubble 40 generated by the film boiling grows to the maximum state. In this state, the liquid in the liquid flow path 3 moves toward the discharge port 4 by the pressure based on the generation of the bubble 40, whereby the movable member 11 is displaced by the growth of the bubble 40 and a liquid droplet 66 is going to be discharged from the discharge port 4. The liquid movement toward the upstream side forms a large current by the presence of the low flow path resistance area, but, when the movable member 11 is displaced to a state in contact with or close to the front end stopper 12*a*, the liquid movement toward the upstream side is restricted at such point because the further displacement of the movable member 11 is prevented by the front end stopper 12*a*. At the same time, the growth of the bubble 40 in the upstream side is limited by the movable member 11. In FIG. 27B, however, since the moving force of the liquid to the upstream side is large, a part of the bubble 40 of which growth is limited by the movable member 11 passes through the gap between the side wall 7 constituting the liquid flow path 3 and the side face of the movable member 11 and extends to the upper side of the movable member 11. Thus there is formed an extended bubble 41 reaching the upper face of the movable member 11. On the other hand, in FIG. 28B, since the gap between the movable member 11 and the side wall 7 is closed by the side stopper 12*b*, there is not formed the extended bubble 41 reaching the upper face of the movable member 11.

When the bubble 40 starts to contact after the aforementioned film boiling, the movable member 11 still remains in contact with the front end stopper 12*a* since there still remains a large moving force of the liquid toward the upstream side, so that the contraction of the bubble 40 mostly generates the liquid movement from the discharge port 4 to the upstream direction. Consequently, at this point, the meniscus is significantly retracted from the discharge port 4 into the liquid flow path 3, whereby a liquid column connected to the discharged droplet 66 is promptly cut off with a strong force. As a result, there is reduced a liquid droplet, or a satellite, left outside the discharge port 4.

When the bubble vanishing step is almost completed, the returning force of the movable member 11 becomes stronger than the moving force of the liquid toward the upstream direction in the low flow path resistance area, whereby started are the downward displacement of the movable member 11 and the resulting flow into the downstream direction in the low flow path resistance area. At the same time, the downstream flow in the low flow path resistance area becomes a large current because of the low flow path resistance, and goes into the liquid flow path 3 through an area close to the front end stopper 12*a*.

In the liquid discharge head of such configuration, a faster refilling is achieved by supplying the discharge liquid from the low flow path resistance area. Such high-speed refilling is enabled because the flow path resistance is further lowered by the common liquid chamber adjacent to the low flow path resistance area.

Also in the vanishing step of the bubble 40, the gap between the side stopper 12*b* and the movable member 11 stimulates the liquid flow from the low flow path resistance area into the bubble generating area on the heat generating member 10, and also completes the vanishing of the bubble, in cooperation with the rapid liquid supply along the surface of the movable member 11, generated when the movable member 11 is separated from the front end stopper 12*a*.

Also in such liquid discharge head, the grooves 13*a* on the front end stopper 12*a* and the grooves 13*f* on the side stoppers 12*b*, in case of the liquid discharge head shown in FIGS. 28A and 28B, enable rapid displacement of the movable member 11, thereby suppressing the ink movement to the upstream side in the liquid flow path 3 in the discharging operation and preventing the deterioration in the response speed of the movable member 11.

The liquid discharge head of the present invention is not limited to the configurations in the foregoing embodiments or of the side shooter type shown in FIGS. 26A to 28B, but the present invention also includes any configuration of reducing the resistance to the movable member, at the displacement thereof, by the liquid layer between the movable member and the limiting member for limiting the movement thereof. Consequently the liquid discharge head of the present invention naturally includes, for example, combinations of the features of the foregoing embodiments such as a configuration where the grooves are formed on both of the movable member and the limiting member so as to obtained the aforementioned effects.

<Movable Member>

In the foregoing embodiments, the movable member is composed of silicon nitride of a thickness of 5 μm, but such material is not restrictive and the movable member may be composed of any material resistant to the discharge liquid and having elasticity for satisfactorily functioning as the movable member.

The movable member is desirably composed of a material of high durability, for example a metal such as silver, nickel, gold, iron, titanium, aluminum, platinum, tantalum, stainless steel or phosphor bronze; alloys thereof; resin having nitrile radicals such as acrylonitrile, butadiene or styrene; resin having amide radicals such as polyamide; resin having carboxyl radicals such as polycarbonate; resin having aldehyde radicals such as polyacetal; resin having sulfone radicals such as polysulfone; other resins such as liquid crystal polymer and compounds thereof; or of high ink resistance, for example a metal such as gold, tungsten, tantalum, nickel, stainless steel or titanium or alloys thereof or substances surfacially coated with such metal or alloy; resin having amide radicals such as polyamide; resin having aldehyde radicals such as polyacetal; resin having ketone radicals such as polyetherether ketone; resin having imide radicals such as polyimide; resin having hydroxyl radicals such as phenolic resin; resin having ethyl radicals such as polyethylene; resin having alkyl radicals such as polypropylene; resin having epoxy radicals such as epoxy resin; resin having amino radicals such as melamine resin; resin having methylol radicals such as xylene resin; and compounds thereof; or ceramics such as silicon dioxide or silicon nitride or compounds thereof. The movable member in the present invention has a thickness in the order of micrometers.

In the following there will be explained the positional relationship between the heat generating member and the movable member. The optimum arrangement of the heat generating member and the movable member allows to appropriately control and effectively utilize the liquid flow at the bubble generation by the heat generating member.

Figure 29:
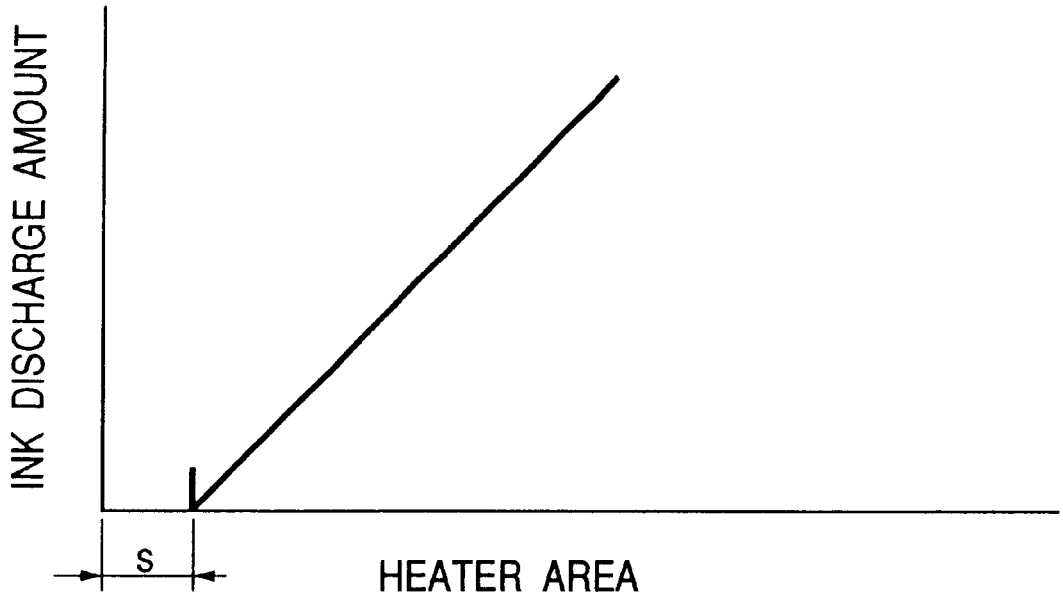
FIG. 29 is a chart showing the relationship between the area of the heat generating member and the ink discharge amount.

In the conventional technology of so-called bubble jet recording method, namely an ink jet recording method in which energy such as heat is given to the ink to generate a state change involving a rapid volume change (bubble generation) in the ink, and the ink is discharged from the discharge port by the action force based on such state change and is deposited on the recording medium to form an image, the area of the heat generating member (heater) is proportional to the ink discharge amount as shown in FIG. 29, but there is present a non-effective bubble generating area S. Based on the state of scorch on the heat generating member, such non-effective bubble generating area S is known to be present around the heat generating member. Based on these results, an area of a width of about 4 μm around the heat generating member is regarded not to contribute to the bubble generation.

Therefore, for effectively utilizing the pressure of the generated bubble, the movable member can be acted on directly above an area of the heat generating member inside such peripheral area of the width of about 4 μm. In the present invention, however, in consideration of the fact that there can be separated a stage of causing the upstream portion and the downstream portion of the bubble in the approximately central area (in practice a range of about ±10 μm with respect to the center along the liquid flow) of the bubble generating area to independently act on the liquid flow in the liquid flow path and a stage of causing the bubble to comprehensively act on the liquid flow, it is extremely important to position the movable member in such a manner that a portion upstream of the above-mentioned central area alone is opposed to the movable member. In the foregoing embodiments, the effective bubble generating area is considered an area of the heat generating area inside a peripheral area of a width of about 4 μm, but such area is not limited to such definition, depending on the kind of the heat generating member of the forming method thereof.

Also for satisfactorily forming the aforementioned substantially closed space, the distance between the movable member and the heat generating member in the waiting state is preferably 10 μm or less.

<Recording Apparatus>

Figure 30:
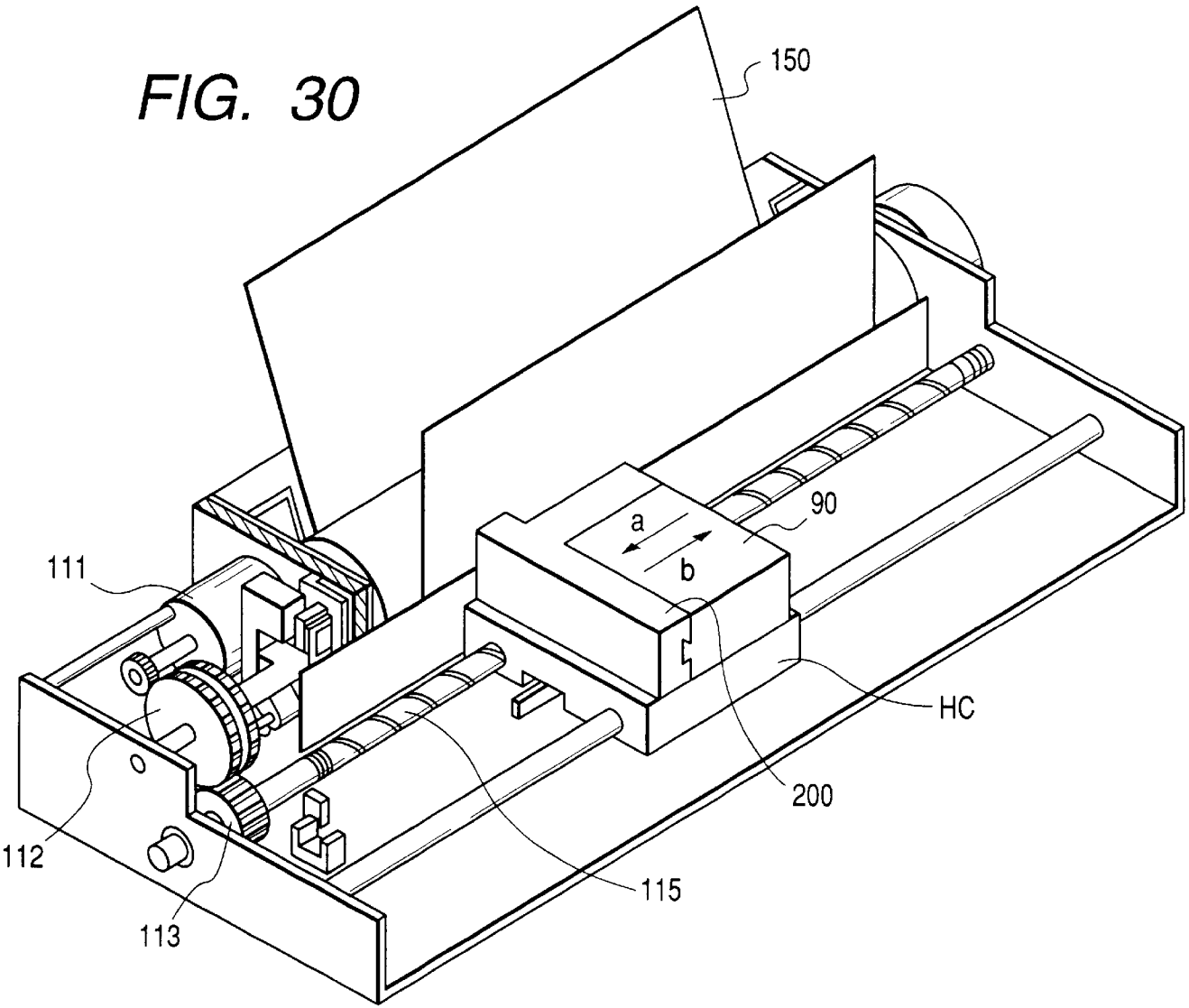
FIG. 30 is a perspective view of an ink jet recording apparatus incorporating a liquid discharge head employing a liquid discharge head of the present invention and utilizing ink as the discharge liquid.

FIG. 30 is a perspective view of an ink jet recording apparatus incorporating a liquid discharge apparatus, including the liquid discharge head of the present invention and employing ink as the discharge liquid. A carriage HC supports a head cartridge in which a liquid tank 90 containing ink and a recording head 200 constituting the liquid discharge apparatus are detachably mounted, and executes a reciprocating motion across the entire width of a recording medium 150, such as a recording sheet, conveying by recording medium conveying means.

In response to the supply of a drive signal from unrepresented drive signal supply means to liquid discharge means on the carriage HC, the recording head discharges ink (recording liquid) onto the recording medium.

The recording apparatus of the present embodiment is provided with a motor 111 for driving the recording medium conveying means and the carriage, gears 112, 113 for transmitting the driving power from the motor 111 to the carriage, a carriage shaft 115 etc. A satisfactory image recording could be obtained by discharging liquid onto various recording media by the above-described recording apparatus and by the liquid discharge method executed by such recording apparatus.

Figure 31:
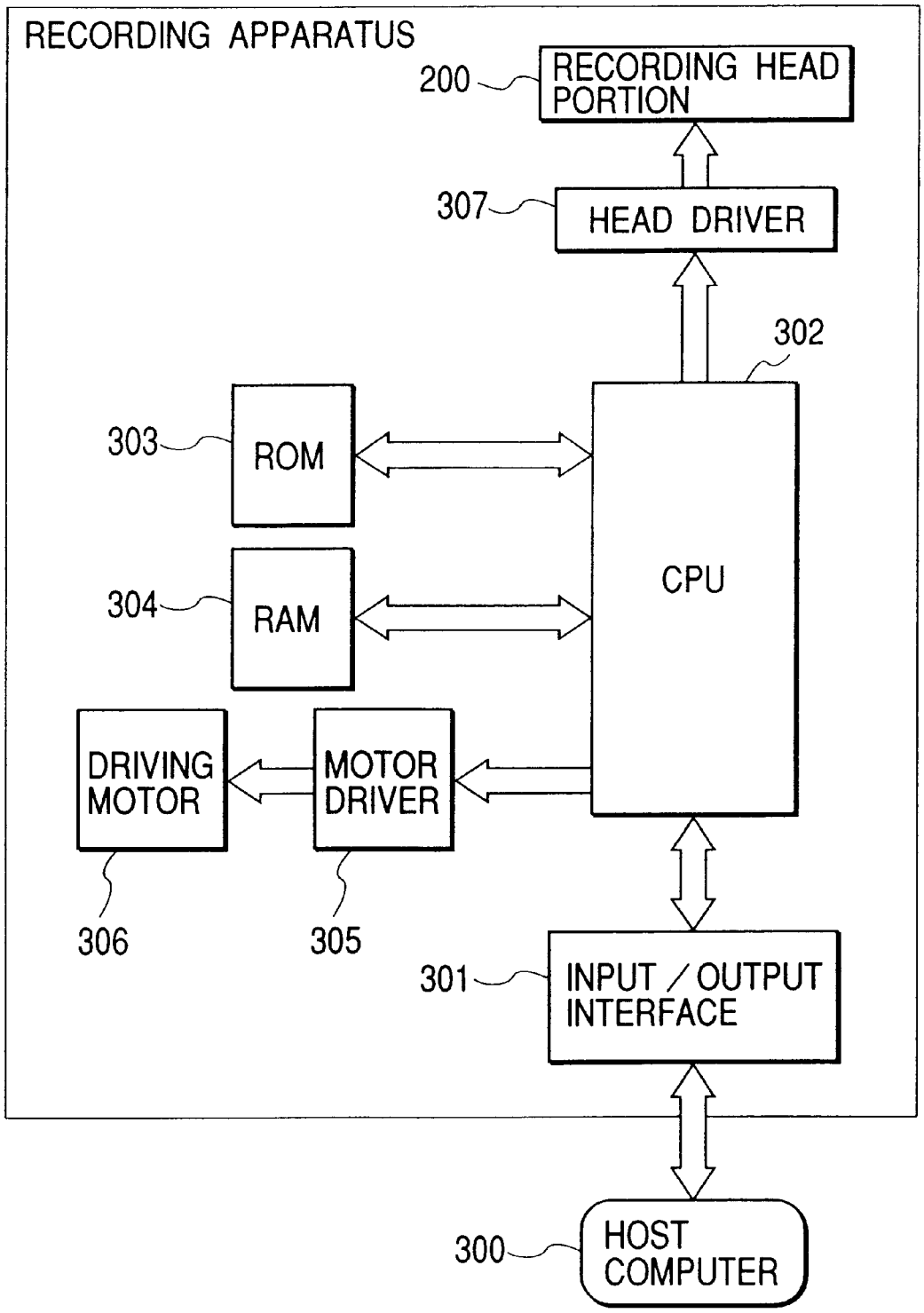
FIG. 31 is a block diagram of the entire recording apparatus for executing ink jet recording by the liquid discharge apparatus of the present invention.

FIG. 31 is a block diagram of the entire recording apparatus for executing ink jet recording by the liquid discharge apparatus of the present invention.

The recording apparatus receives recording information, as a control signal, from a host computer 300. The recording information is temporarily stored in an input interface 301 in the recording apparatus, and at the same time converted into data processable therein, and entered into a CPU (central processing unit) 302 serving also as head drive signal supply means. The CPU 302 processes the data entered thereto utilizing peripheral units such as a RAM (random access memory) 302, 304 and based on a control program stored in a ROM (read-only memory) 303, thereby effecting conversion into recording data (image data).

The CPU 302 also prepares drive data for driving a driving motor 306, for moving the recording sheet and the carriage HC supporting the recording head, in synchronization with the image data, in order to record the image data in an appropriate position on the recording sheet. The image data and the motor driving data are respectively transmitted, through a head driver 307 and a motor driver 305, to the recording head 200 and the driving motor 306 which are thus driven in respectively controlled timings to form the image.

The recording medium 150 to be employed in such recording apparatus and to receive the deposition of liquid such as ink can be various papers, an OHP sheet, a plastic material employed in a compact disk or a decorating plate, a cloth, a metal material such as of aluminum or copper, a leather material such as cow hide, pig hide or synthetic leather, wood, a wooden material such as plywood, bamboo, ceramics such as a tile, or a three-dimensionally structured material such as sponge.

Also the recording apparatus includes a printer apparatus for recording on various papers or OHP sheet, a plastic recording apparatus for recording on plastic such as a compact disk, a metal recording apparatus for recording on a metal plate, a leather recording apparatus for recording on leather, a wood recording apparatus for recording on a wooden material, a ceramic recording apparatus for recording on ceramics, a recording material for recording on a three-dimensional network structured member such as sponge, and a dyeing apparatus for recording on a cloth.

Also the discharge liquid to be employed in such liquid discharge apparatus can be selected according to the respective recording medium and the recording conditions.

According to the present invention, as explained in the foregoing, the limiting portion for limiting the displacement of the movable member in the liquid flow path to the desired range and the movable member come into substantial contact to separate the upstream side and the downstream side of the liquid flow path, thereby forming a substantially closed state by the movable member and the limiting portion, and irregularities are formed on at least either of the faces of such movable member and limiting portion to reduce the resistance to the movable member by the liquid layer between the limiting portion and the movable member and to reduce the time required by the movable member to contact the limiting member when the movable member approaches the limiting member. Therefore, there can be provided effects of suppressing the liquid movement to the upstream side in the liquid flow path in the discharging operation and decreasing the loss of the bubble generating energy of the bubble generating member. Also there is reduced the time required by the movable member to return to the initial position from the limiting portion, whereby the deterioration of the response speed (response frequency) of the movable member can be prevented. Also in the liquid discharge operation from the discharge port, there can be suppressed the vibration of the meniscus and stable recording quality can be attained from a low driving frequency to a high driving frequency.

What is claimed is:

1. A liquid discharge head comprising:

a heat generating member for generating thermal energy for generating a bubble in liquid;

a discharge port constituting a part for discharging said liquid;

a liquid flow path communicating with said discharge port and having a bubble generating area for generating the bubble in said liquid;

a movable member provided in said bubble generating area and adapted to displace with the growth of said bubble; and a limiting portion for limiting the displacement of said movable member within a desired range, wherein said liquid discharge head may be adapted to discharge said liquid from said discharge port by the energy at the generation of said bubble by said heat generating member, wherein said limiting portion is provided opposed to said bubble generating area of said liquid flow path, and said movable member, displaced by the growth of said bubble, comes into a substantial contact with said limiting portion to separate the upstream side and the downstream side of said liquid flow path, therein forming a substantially closed state by said movable member and said limiting portion, and at least either of the surfaces of said movable member and said limiting portion is formed as a surface with irregularities, wherein said surface with irregularities is provided at a point where said movable member comes into contact with said limiting portion.

2. A liquid discharge head according to claim 1, wherein said irregularities are constituted by forming grooves on a surface to be provided with said irregularities.

3. A liquid discharge head according to claim 1, further comprising a side limiting portion of which at least a part comes into substantial contact with a side portion of said movable member displaced by the growth of said bubble.

4. A liquid discharge head comprising:

a heat generating member for generating thermal energy for generating a bubble in liquid;

a discharge port constituting a part for discharging said liquid;

a liquid flow path communicating with said discharge port and having a bubble generating area for generating the bubble in said liquid;

a movable member provided in said bubble generating area and adapted to displace with the growth of said bubble; and a limiting portion for limiting the displacement of said movable member within a desired range, wherein said liquid discharge head may be adapted to discharge said liquid from said discharge port by the energy at the generation of said bubble by said heat generating member, wherein said limiting portion is provided opposed to said bubble generating area of said liquid flow path, and said movable member, displaced by the growth of said bubble, comes into a substantial contact with said limiting portion to separate the upstream side and the downstream side of said liquid flow path, therein forming a substantially closed state by said movable member and said limiting portion, and at least either of the surfaces of said movable member and said limiting portion is formed as a surface with irregularities, wherein said irregularities have a comb-tooth shape.

5. A liquid discharge head comprising:

a heat generating member for generating thermal energy for generating a bubble in liquid;

a discharge port constituting a part for discharging said liquid;

a liquid flow path communicating with said discharge port and having a bubble generating area for generating the bubble in said liquid;

a movable member provided in said bubble generating area and adapted to displace with the growth of said bubble; and a limiting portion for limiting the displacement of said movable member within a desired range, wherein said liquid discharge head may be adapted to discharge said liquid from said discharge port by the energy at the generation of said bubble by said heat generating member, wherein said limiting portion is provided opposed to said bubble generating area of said liquid flow path, and said movable member, displaced by the growth of said bubble, comes into a substantial contact with said limiting portion to separate the upstream side and the downstream side of said liquid flow path, therein forming a substantially closed state by said movable member and said limiting portion, and at least either of the surfaces of said movable member and said limiting portion is formed as a surface with irregularities, wherein said irregularities have a comb-tooth shape, wherein said irregularities of comb-tooth shape are constituted by forming plural grooves, extending along the direction of said liquid flow path, on a surface to be provided with said irregularities.

6. A liquid discharge head comprising:

a heat generating member for generating thermal energy for generating a bubble in liquid;

a discharge port constituting a part for discharging said liquid;

a liquid flow path communicating with said discharge port and having a bubble generating area for generating the bubble in said liquid;

a movable member provided in said bubble generating area and adapted to displace with the growth of said bubble; and a limiting portion for limiting the displacement of said movable member within a desired range, wherein said liquid discharge head may be adapted to discharge said liquid from said discharge port by the energy at the generation of said bubble by said heat generating member, wherein said limiting portion is provided opposed to said bubble generating area of said liquid flow path, and said movable member, displaced by the growth of said bubble, comes into a substantial contact with said limiting portion to separate the upstream side and the downstream side of said liquid flow path, therein forming a substantially closed state by said movable member and said limiting portion, and at least either of the surfaces of said movable member and said limiting portion is formed as a surface with irregularities, wherein said irregularities have a comb-tooth shape, wherein said irregularities of comb-tooth shape are constituted by forming plural grooves, extending along the direction of said liquid flow path, on a surface to be provided with said irregularities, wherein said plural grooves have a same length and are arranged in a zigzag manner in a direction perpendicular to the liquid flow path in such a manner that the two neighboring grooves have mutually different longitudinal positions.

7. A liquid discharge head comprising:

a heat generating member for generating thermal energy for generating a bubble in liquid;

a discharge port constituting a part for discharging said liquid;

a liquid flow path communicating with said discharge port and having a bubble generating area for generating the bubble in said liquid;

a movable member provided in said bubble generating area and adapted to displace with the growth of said bubble; and a limiting portion for limiting the displacement of said movable member within a desired range, wherein said liquid discharge head may be adapted to discharge said liquid from said discharge port by the energy at the generation of said bubble by said heat generating member, wherein said limiting portion is provided opposed to said bubble generating area of said liquid flow path, and said movable member, displaced by the growth of said bubble, comes into a substantial contact with said limiting portion to separate the upstream side and the downstream side of said liquid flow path, therein forming a substantially closed state by said movable member and said limiting portion, and at least either of the surfaces of said movable member and said limiting portion is formed as a surface with irregularities, wherein said irregularities are constituted by forming island-shaped projections on a surface to be provided with said irregularities.

8. A liquid discharge head comprising:

a heat generating member for generating thermal energy for generating a bubble in liquid;

a discharge port constituting a part for discharging said liquid;

a liquid flow path communicating with said discharge port and having a bubble generating area for generating the bubble in said liquid;

a movable member provided in said bubble generating area and adapted to displace with the growth of said bubble; and a limiting portion for limiting the displacement of said movable member within a desired range, wherein said liquid discharge head may be adapted to discharge said liquid from said discharge port by the energy at the generation of said bubble by said heat generating member, wherein said limiting portion is provided opposed to said bubble generating area of said liquid flow path, and said movable member, displaced by the growth of said bubble, comes into a substantial contact with said limiting portion to separate the upstream side and the downstream side of said liquid flow path, therein forming a substantially closed state by said movable member and said limiting portion, and at least either of the surfaces of said movable member and said limiting portion is formed as a surface with irregularities, wherein a recessed portion of said irregularities is constituted by a hole, of which an aperture end is formed on a surface different from the surface having said irregularities.

9. A liquid discharge head comprising:

a heat generating member for generating thermal energy for generating a bubble in liquid, a discharge port constituting a portion for discharging said liquid, a liquid flow path communicating with said discharge port and including a bubble generating area for generating said bubble in said liquid, a movable member provided in said bubble generating area and adapted to displace with the growth of said bubble, and a limiting portion for limiting the displacement of said movable member within a desired range, the liquid discharge head being adapted for discharging said liquid from said discharge port by the energy at the generation of said bubble by said heat generating member, wherein said limiting portion is provided opposed to said bubble generating area of said liquid flow path, and said movable member, displaced by the growth of said bubble, comes into substantial contact with said limiting portion to separate the upstream side and the downstream side of said liquid flow path therein forming a substantially closed state by said movable member and said limiting portion, and at least either of the surfaces of said movable member and said limiting portion is provided with a first exhaustion accelerating structure for exhausting said liquid, present in an area between said movable member and said limiting portion prior to the contact of said movable member and said limiting portion, to the exterior of such area.

10. A liquid discharge head according to claim 9, wherein said first exhaustion accelerating structure is irregularities formed on at least either of the surfaces of said movable member and said limiting portion, where the movable member displaced by the growth of said bubble and said limiting portion come into substantial contact.

11. A liquid discharge head according to claim 10, wherein said irregularities are constituted by forming grooves on a surface to be provided with said irregularities.

12. A liquid discharge head according to claim 10, wherein said irregularities have a comb-tooth shape.

13. A liquid discharge head according to claim 12, wherein said irregularities of comb-tooth shape are constituted by forming plural grooves, extending along the direction of said liquid flow path, on a surface to be provided with said irregularities.

14. A liquid discharge head according to claim 13, wherein said plural grooves have a same length and are arranged in a zigzag manner in a direction perpendicular to the liquid flow path in such a manner that the two neighboring grooves have mutually different longitudinal positions.

15. A liquid discharge head according to claim 10, wherein said irregularities are constituted by forming island-shaped projections on a surface to be provided with said irregularities.

16. A liquid discharge head according to claim 10, wherein a recessed portion of said irregularities is constituted by a hole, of which an aperture end is formed on a surface different from the surface having said irregularities.

17. A liquid discharge head according to claim 9, further comprising a side limiting portion of which at least a part comes into substantial contact with a side portion of said movable member displaced by the growth of said bubble.

18. A liquid discharge head according to claim 17, further comprising, on at least either of the surfaces of said movable member and said side limiting portion where said movable member displaced by the growth of said bubble and said side limiting portion come into substantial contact, a second exhaustion accelerating structure for exhausting said liquid, present in an area between said movable member and said side limiting portion prior to the contact of said movable member and said side limiting portion, to the exterior of said area.

19. A liquid discharge head according to claim 18, wherein said second exhaustion accelerating structure is irregularities provided on at least either of the surfaces of said movable member and said side limiting portion where said movable member displaced by the growth of said bubble and said side limiting portion come into substantial contact.

20. A liquid discharge head according to claim 19, wherein said irregularities are constituted by forming grooves on a surface to be provided with said irregularities.

21. A liquid discharge head according to claim 20, wherein said irregularities have a comb-tooth shape.

22. A liquid discharge head according to claim 21, wherein said irregularities of comb-tooth shape are constituted by forming plural grooves, extending along the direction of said liquid flow path, on a surface to be provided with said irregularities.

23. A liquid discharge head according to claim 22, wherein said grooves are arranged in a zigzag manner in such a manner that the two neighboring grooves have mutually different longitudinal positions.

24. A liquid discharge head according to claim 19, wherein said irregularities are constituted by forming island-shaped projections on a surface to be provided with said irregularities.

25. A liquid discharge head according to claim 19, wherein a recessed portion of said irregularities is constituted by a hole, of which an aperture end is formed on a surface different from the surface having said irregularities.

26. A head cartridge comprising a liquid discharge head according to claim 1 or claim 9, and a liquid container for holding the liquid to be supplied to said liquid discharge head.

27. A liquid discharge apparatus comprising a liquid discharge head according to claim 26, and drive signal supply means for supplying a drive signal for causing said liquid discharge head to discharge the liquid.

28. A liquid discharge apparatus comprising a liquid discharge head according to claim 27, and recording medium conveying means for conveying a recording medium for receiving the liquid discharged from said liquid discharge head.

29. A liquid discharge apparatus according to claim 28, adapted to execute recording by discharging liquid from said liquid discharge head and depositing said liquid onto a recording medium.

30. A liquid discharge apparatus according to claim 27, adapted to execute recording by discharging liquid from said liquid discharge head and depositing said liquid onto a recording medium.

31. A liquid discharge apparatus comprising a liquid discharge head according to claim 26, and recording medium conveying means for conveying a recording medium for receiving the liquid discharged from said liquid discharge head.

32. A liquid discharge apparatus according to claim 31, adapted to execute recording by discharging liquid from said liquid discharge head and depositing said liquid onto a recording medium.

33. A liquid discharge apparatus comprising a liquid discharge head according to claim 1 or claim 9, and drive signal supply means for supplying a drive signal for causing said liquid discharge head to discharge the liquid.

34. A liquid discharge apparatus comprising a liquid discharge head according to claim 33, and recording medium conveying means for conveying a recording medium for receiving the liquid discharged from said liquid discharge head.

35. A liquid discharge apparatus according to claim 34, adapted to execute recording by discharging liquid from said liquid discharge head and depositing said liquid onto a recording medium.

36. A liquid discharge apparatus according to claim 33, adapted to execute recording by discharging liquid from said liquid discharge head and depositing said liquid onto a recording medium.

37. A liquid discharge apparatus comprising a liquid discharge head according to claim 1 or claim 9, and recording medium conveying means for conveying a recording medium for receiving the liquid discharged from said liquid discharge head.

38. A liquid discharge apparatus according to claim 37, adapted to execute recording by discharging liquid from said liquid discharge head and depositing said liquid onto a recording medium.

* * * * *